US008266730B2

(12) United States Patent
Ricca

(10) Patent No.: US 8,266,730 B2
(45) Date of Patent: Sep. 18, 2012

(54) HANDS-FREE TOILET ATTACHMENT

(76) Inventor: Tom L. Ricca, Columbus, OH (US)

( * ) Notice: Subject to any disclaimer, the term of this patent is extended or adjusted under 35 U.S.C. 154(b) by 561 days.

(21) Appl. No.: 12/583,215

(22) Filed: Aug. 17, 2009

(65) Prior Publication Data

US 2011/0035866 A1 Feb. 17, 2011

(51) Int. Cl.
*A47K 13/10* (2006.01)

(52) U.S. Cl. ..... 4/246.3; 4/246.1; 4/246.2; 4/248; 4/249; 4/250

(58) Field of Classification Search ..... 4/246.1, 4/246.2, 246.3, 246.4, 246.5, 248, 249, 250; 220/262, 263, 264
See application file for complete search history.

(56) References Cited

U.S. PATENT DOCUMENTS

| | | | | |
|---|---|---|---|---|
| 3,055,016 | A * | 9/1962 | Kemp | 4/246.5 |
| 4,030,146 | A * | 6/1977 | Pilkington et al. | 4/246.5 |
| 5,075,906 | A * | 12/1991 | Robbins | 4/246.5 |
| 5,339,468 | A * | 8/1994 | Lin | 4/246.5 |
| 5,444,877 | A * | 8/1995 | Kumarasurier | 4/246.1 |
| 5,781,938 | A * | 7/1998 | Anderson | 4/246.1 |
| 5,978,974 | A * | 11/1999 | Mullen | 4/246.5 |
| 6,112,335 | A * | 9/2000 | Gaston | 4/246.1 |
| 6,112,336 | A * | 9/2000 | Markle et al. | 4/246.1 |
| 6,807,687 | B2 * | 10/2004 | Marras | 4/246.1 |
| 6,907,621 | B2 * | 6/2005 | Stemen | 4/246.1 |
| 7,003,815 | B2 * | 2/2006 | Herbst | 4/246.2 |
| 7,254,846 | B2 * | 8/2007 | Kim | 4/246.3 |
| 7,331,067 | B2 * | 2/2008 | Pantos et al. | 4/246.1 |
| 7,367,066 | B1 * | 5/2008 | Reid | 4/246.1 |
| 7,861,328 | B1 * | 1/2011 | Joo et al. | 4/246.1 |
| 2009/0188030 | A1 * | 7/2009 | Tong et al. | 4/246.3 |

* cited by examiner

*Primary Examiner* — Gregory Huson
*Assistant Examiner* — Christine Skubinna

(57) ABSTRACT

A novel attachment on a toilet system for a male user to raise a toilet seat (100), by depressing a pedal (30) with a foot and then releasing it, while standing well balanced on his second foot, so that he can urinate comfortably with both feet on the floor; and then to lower same seat (100) by depressing same pedal (30) and releasing it; with all these actions done with no startling noise against the water tank (104) or the toilet bowl rim. The dual operation of the same pedal (30) can provide a timely flushing of the toilet automatically when seat (100) is lowered, without hand touching any part of the toilet system. The attachment can add, with a secondary pedal (140), a hands-free flushing system that can be operated without moving toilet seat (100) when it is already in the lowered position. All manual toilet-system operations are preserved.

5 Claims, 10 Drawing Sheets

HANDS-FREE TOILET ATTACHMENT

BACKGROUND

1. Field

This application relates to a novel toilet attachment for a male user to raise a toilet seat, by depressing effortlessly and leisurely a pedal with a foot, while standing well balanced on his second foot, in a manner that he can urinate comfortably with both feet on the floor, away from the pedal; and then to lower the same seat by depressing effortlessly and leisurely the same unmistakable pedal again; with all these actions done with no startling noise against the water tank or the toilet bowl rim. The dual operation of the same pedal also provides, if desired, a timely flushing of the toilet automatically when the seat is lowered, without hand touching any part of the toilet system. With the basic embodiment in place, it is easy to add, by way of a secondary pedal, a hands-free flushing system that can be operated without moving the toilet seat when it is already in the lowered position.

2. Prior Art

Hands-free operation of raising and lowering a toilet seat has been recognized and described in great details in prior art as a real sanitary need and proper courtesy practice for home use and in public restrooms. Some interesting thoughts may be quoted verbatim from non-copyrighted prior art. For example:

From U.S. Pat. No. 5,781,938 to Anderson: "Since the development of the hinged toilet seat, a relatively minor skirmish in the battle of the sexes has been waged over the issue of whether or not the seat (and in some cases, the lid also) should be left in its lowered position after use. Many men leave the seat up after urination, as this is the normal and customary way of using the toilet for such purpose. Women, however, universally use the toilet with the seat in its lowered position, and have come to expect to find the seat, if not the lid also, in the lowered position when they enter the bathroom. Many a man have found it necessary to revise his habits relating to such when living with a woman in the same household, and the habit is not an easy one for men to revise in many cases, even with numerous reminders from the distaff side of the household."

From U.S. Pat. No. 5,978,974 to Mullen: "A common concern of women, who share toilet facilities with men, is that men tend to leave the toilet seat in the raised position. If a woman does not notice that the toilet seat is raised, she risks falling into the bowl and potentially becoming injured by attempting to sit on the toilet when the seat is raised.

A common problem faced by men when raising a toilet seat is that they must touch the actual seat, thus potentially receiving bacteria and other germs from the seat. In addition, people who have difficulty in bending over find it difficult to raise a toilet seat in the traditional way."

From U.S. Pat. No. 4,030,146 to Pilkington et al: "It is generally known that many persons find it objectionable to handle any part of a toilet, particularly a public toilet that may be used by all types of persons with various habits of cleanliness. In view of the fact that the toilet seat should be raised when a man is in the act of urinating, devices are available for lifting the toilet seat when a pedal is depressed."

From U.S. Pat. No. 5,075,906 to Robbins: "Conventionally, a user intending to avoid touching of the seat, will use his feet, loose sticks or the like in order to raise or lower the seat. -------.

Using a person's shoe or stick is extremely rudimentary and is not always successful in raising or lowering the seat in a convenient manner and one which will not break or damage the seat."

In a survey of the market, there are a few hands-free attachments for raising and/or lowering a toilet seat on some websites. This surveying was done, for example, by entering a search engine the term "toilet seat lifter". These attachments and numerous relevant U.S. patents and their cited prior art reveal no single embodiment that can satisfy the majority or all of the desirable features. Among some prominent patents in prior art, a few can be singled out as better than others, yet still can be seen as obviously deficient of the features to be improved upon.

For the purpose of providing raising and lowering a toilet seat, U.S. Pat. No. 7,367,066 to Reid requires one foot to be on the pedal after the seat is raised for urinating. This is understandably hazardous and rejected vehemently by potential users.

U.S. Pat. No. 7,331,067 to Pantos uses a single pedal for both raising and lowering a toilet seat. Shown in the patent writing as well as in the video found on the Internet, it has the drawback of requiring a lengthy foot travel in depressing the pedal to raise the seat and unusually awkward, non-intuitive, lifting of the same pedal in whatever way, to lower the seat. The lengthy foot travel needed in the seat raising operation can cause a user to lose his or her balance without the hand of the user holding onto something, or from balancing the arms in a way different from those normally found on a man about to urinate. It is awkward and difficult to lower the seat, especially in low-light environments. It further requires toilet seats to be specially made, or conventional seats to be permanently modified.

U.S. Pat. No. 7,254,846 to Kim seems desirably simple; but requires two separate pedals located near each other. It is thus proven as confusing and presenting possible interference between the two pedals when one being pushed down would cause forcedly the other one to go up. It has no anti-slamming provision in the form of a shock absorber. It lacks even the basic ability by foot to restrain the violent going-down movement of the seat, once it is initiated to fall forward. This fact can be seen easily by analyzing FIG. 2 of that patent.

U.S. Pat. No. 6,112,336 to Marke et al, seems more viable than many others. It claims not to impede the raising or lowering of the seat by hand. However, a latch is shown for keeping the seat latched in the vertical position. This latch can be destroyed, if, after a seat is raised and latched, this seat lowering is initiated inadvertently by hand then followed by the weight of the seat. Furthermore, after a few operations in real life, its use of a suction cup to aid the lowering of the seat can be seen as undependable and unreliable.

U.S. Pat. No. 5,444,877 to Kumarasurier uses a single pedal for sequentially raising and lowering the seat, but suffers from not being able to use existing toilet seat without extensive modifications. It requires numerous mechanical components to be made and assembled with precision with additional expenses; and the speed in lowering the seat needs to be controlled with a foot on the pedal.

U.S. Pat. No. 5,339,468 to Lin uses a single pedal for sequentially raising and lowering the seat; but suffers from not being able to use existing toilet seats without extensive modifications. It cannot be installed on the left side of the toilet bowl, or on different heights of the toilet bowls easily. Furthermore, its linkages to the seat and flushing handle cannot be covered aesthetically. These linkages prevent the manual use of the flushing handle (also called the trip lever) and the manual lifting and lowering of the seat may cause the mechanisms to break easily.

Specific Goals of the Invention

Obviously, the prior art suffers from several disadvantages, and a long-standing need has existed to provide a novel means to overcome and avoid these disadvantages. The list of issues to deal with is established below as a real wish list of desiderata.

An issue of prime import is that most men would raise the seat of a toilet from a standing position and remain standing in a steady position on their two feet for comfort, stability, and a hazard-free urination.

Another issue with any hands-free system is that the operation of any device should be the least confusing possible. Specifically, if foot actuation is used, non-critical and effortless successive depressions of a single pedal for raising as well as lowering of the seat would prove to be most intuitive for users.

Another commercially viable feature is the raising and lowering of the seat without slamming the seat against the toilet water tank or toilet bowl rim with a disquieting noise and potentially destructive impact force.

It would be also a great bonus to users if beyond all the above qualities, a hands-free way of flushing the toilet simultaneously with the foot pedaling to lower the seat; or foot pedaling a distinctly unmistakable lever, after using the toilet when its seat is already in the down position. This is especially of great help for people, male or female, who cannot bend down easily to manually lift the toilet seat or push the flushing handle, due to disabilities, handicaps or arthritis.

It is also desirable that any attachment for hands-free toilet operations should not damage itself in any way, and should not resist with any unusual strength to the operations on the seat, lid, and flushing when they are manually actuated in the conventionally familiar manner of users who are unaware of, who intuitively expect the best from, or who ignore deliberately, the operations of the system attachment on the toilet. These last features are necessary for any toilet attachment to be acceptable for purchase by buyers, instead of being cursed with derogatory remarks as a poorly-designed or overly-mechanistic fixture.

Another desirable feature is the foot-actuated raising of the seat followed by an inadvertent lowering of the seat by hand and carrying on by the weight of the seat, or the inadvertent manual raising the seat followed by a foot pedal action which systematically is designed to raise the seat, should not damage any part of the mechanism or upset any of subsequent operations of the attachment.

Adding to the desirability is the hands-free actuation of raising and lowering both the toilet's seat and lid at the same time for safety concerns for kids or pets.

Beyond all these features, other design criteria such as: low cost; high quality; easy and quick installation on either side of the majority of conventional toilets of any height; requiring no modification of the toilet or surrounding structure; low maintenance; great durability; pleasing appearance and ease of cleaning; provision for easy cleaning of surrounding space; resistance to water splashing and cleaning chemicals around bathrooms; free standing that will not require bolting onto the floor; would be realistically desirable.

The present invention aims at making this wish list of desiderata a reality, using low-cost mechanical multi-bar linkages and memories in binary logic. Made out of rustproof and self-lubricating materials, these elements, when designed to function in binary states, are mathematically easy to calculate for lower bill of materials as well as for better reliability and durability. The result is an inexpensive novel attachment that works with unmodified conventional toilet seats; uses no electricity; provides as much as possible the freedom from hand touching anything other than clean toilet paper; at the same time satisfies all the desiderata listed above.

SUMMARY

In accordance with one embodiment a hands-free toilet attachment comprises:

- a flat supporting base plate serving as the common base of mechanical linkage for the cooperating elements;
- a foot pedal pivoting on a plan parallel to the supporting base plate, around an axis at one of its ends;
- a first U-shaped metal rod transmitting the pedal movements onto a first lever on the swinging down movement only, while detaching itself from this first lever during the time the pedal swings up;
- a second U-shaped metal rod transmitting the pedal movements onto a first arm of a mechanical toggle serving as a memory of the transient period when the toilet seat is urged to be falling down;
- a third U-shaped metal rod transmitting the movements of the first arm of the mechanical toggle onto a fulcrum on a third lever;
- a fourth and fifth U-shaped metal rods transmitting the movements of the first lever onto a well-defined aperture and a well defined cut out area of a second lever, respectively;
- a sixth U-shaped metal rod transmitting the pedal movements onto a mechanical flip-flop serving as a memory of the state, up or down, of the toilet seat;
- a first torsional spring around the axis of the first lever that urges it, when free, to swing upward after this lever is pulled downward by the foot pedal, for the purpose of latching the seat into a stable position leaning against the lid in front of the water tank in well-designed cooperation with the upper end of the fifth U-shaped metal rod; this first torsional spring being there for the purpose of moving the upper end of the fifth U-shaped metal rod, at the right time, into freeing the second lever for it to rotate away from the underside of the seat;
- a second torsional spring on the first lever that bears against the lower end of the second U-shaped metal rod to cooperate in a well-behaved manner with the second lever to accommodate harmlessly an inadvertent manual lowering of the seat when it has been latched in the raised position, helping to safeguard the embodiment;
- a metal Z-shaped wire form anchored on a point of the flip-flop serving, when the seat is lowered, to reset the flip-flop correctly for raising the seat the next time when the foot pedal is depressed, if the seat lowering operation caused any disturbance in the flip-flop memory.

The second lever rotates around an axis parallel to the rotational axis of the toilet seat, and equipped with a plastic rolling pin at one of its ends to bear on the under side of the toilet seat for the purpose of raising the seat at the swinging-up movement of the second lever, and also for transmitting the downward movement of the seat, when it is lowering, onto the first lever in order for it to actuate an adjustable damping dashpot for the seat not to slam down violently onto the rim of the toilet bowl. This rolling pin acts with the toilet seat by gentle rolling actions when the second lever moves, and specifically not attached permanently onto the underside of the toilet seat.

The third lever rotates conveniently around the same axis of the second lever, and equipped with a plastic rolling pin at one of its ends to bear, only at the beginning of the seat lowering time, on a part of the top side of the toilet seat, when the seat is in the up-position only, for the purpose of urging decidedly the seat to move forward, when free, so that the center of gravity of the seat would go past the vertical line toward the falling tendency before the gravity force on the seat would take over to finish the lowering.

This third lever is linked to the first arm of the mechanical toggle with a sixth U-shaped metal rod. The toggle serves to exert a well defined, desirable strong force on the plastic rolling pin of the third lever near the point where the toggling is taking place, thanks to the well-known toggle principle. When latched into a position near or at the point of toggling action, this toggle also behaves as a memory of the transient period when the toilet seat is urged to be falling down. The two-dimensional arc described by a chosen point on the third lever along with the memory that hold the end-of-the-arc location of the point is used very efficiently to pull a properly anchored sheathed cable to cooperate with a linkage that pushes up the flushing rod (also called the lift rod) inside the toilet water tank to flush reliably the toilet every time the first arm of the toggle is moved through the just-described arc by the foot action in lowering the seat by the embodiment or otherwise. This can be visualized as a complete hands-free toilet attachment not only for the males of a family to use during urination, but also for both male and female members in the use of the toilet for defecation, albeit—unless manual clean wiping of the bowl with a piece of toilet paper is anticipated—with one redundant operation of raising an already-lowered seat and lowering it again just for the hands-free flushing in the basic embodiment.

With the basic embodiment in place, provisions can be made to include easily a secondary pedal distinctly made smaller and positioned away from the first foot pedal for strictly actuating only the first arm of the toggle of the basic embodiment to flush the toilet any time without moving the toilet seat when it is already in the lowered position. It will be explained in details later that the action on this secondary pedal would not move the seat at all. The addition of this last foot pedal can make the embodiment highly marketable as an inexpensive, truly complete hands-free toilet attachment—compared to automatic flushing systems that would or would not raise and lower the seat—not only for homes but also for public institutions such as hotels, hospitals, churches, restaurants, sport stadiums, highway rest stops etc. . . . for the use of both men and women in common or in separate rest rooms.

One additional novel accessory can be added to the basic embodiment for potential users who want to use the present invention but insist on continuing to use their preferable toilet seats and lids made out of very heavy and hard materials. They have raised and lowered such seats gingerly by hand up until now, to avoid very hard slamming noise against the toilet water tank and bowl rim. This accessory will be described later in details as a simple, elegant and definitively correct engineering solution to the problem of critically damping the impact noise and vibrations of a toilet seat (or seat and lid) when raised to stay in the open position leaning against the front part of the toilet water tank.

The whole embodiment can be made very compact relative to the size of the majority of toilet bowl and water tank found in homes and public use. It can be configured in an aesthetic enclosure that covers all working components—except the external parts of the levers for raising and lowering the seat and eventually for foot flushing—from view, dust, water splashing, foreign dropping objects etc. . . . ; and blends anything visible into the general look of the bathroom, away from the intimidating industrial/mechanical look, for better visual pleasure and greater marketability.

The reader can appreciate more completely the present invention and its scope from the accompanying drawings that are briefly described below, from the following detailed description of different embodiments of the invention, and from the appended claims.

In the drawings, closely related figures have the same number but different alphabetic suffixes.

DRAWINGS—FIGURES

Figure 1:
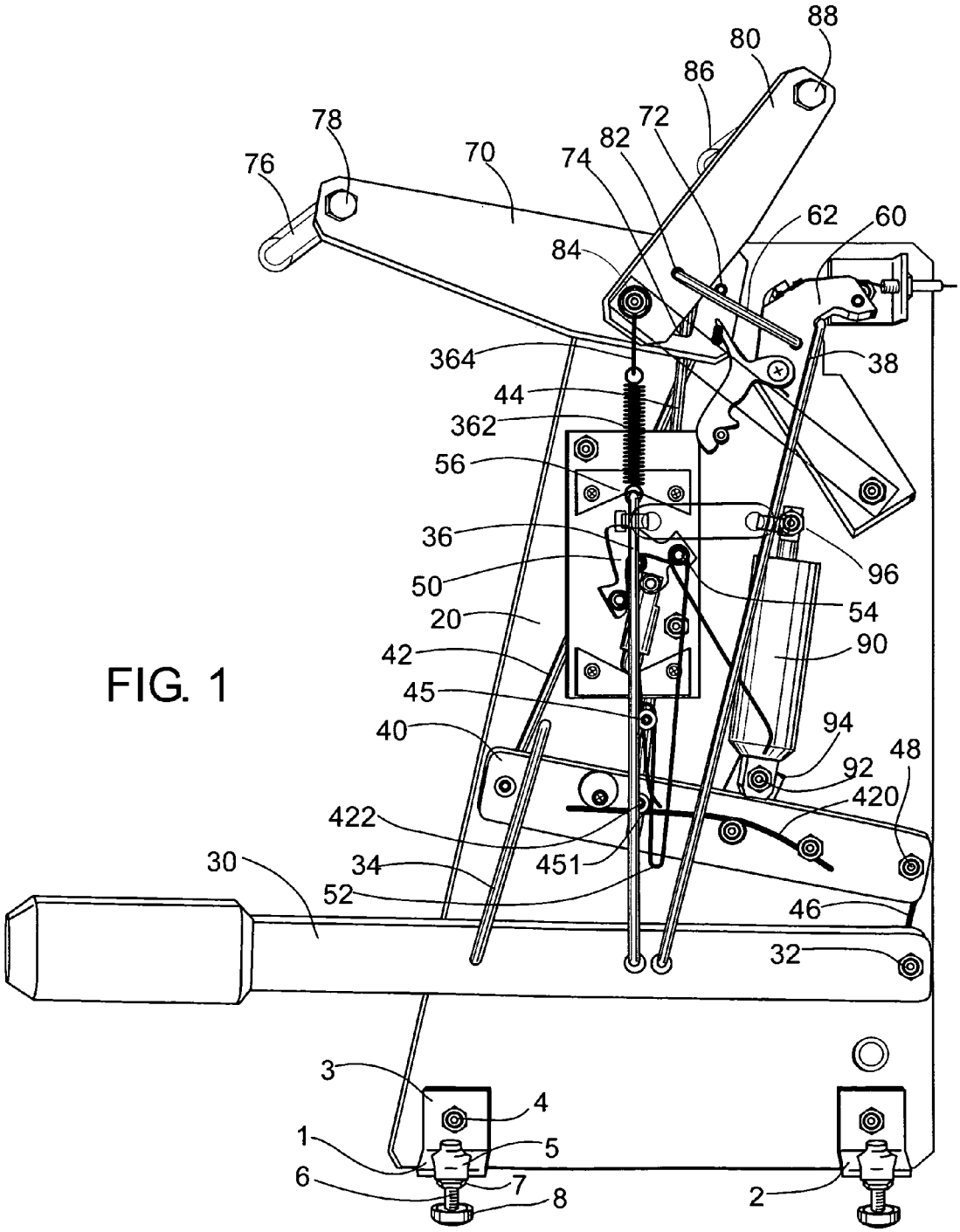
FIG. 1 shows the internal mechanism of the basic embodiment of the application in a situation where the toilet seat rests in the down position.
Figure 4:
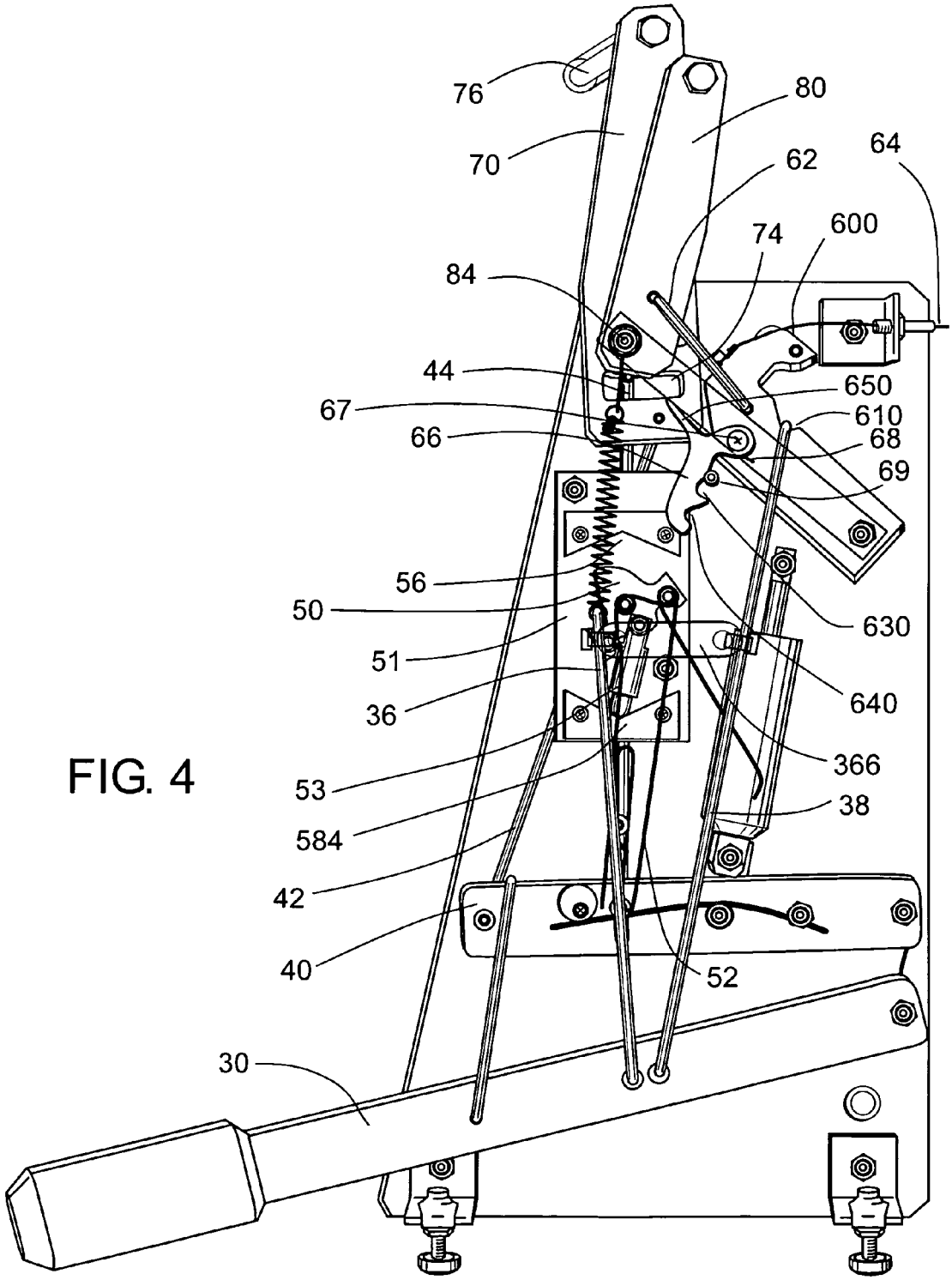

FIG. 4 shows the embodiment with the pedal being depressed to its lowest position in the operation designed to lower the seat. Also shown is the mechanism that links this operation with the concomitant flushing of the toilet. When the pedal is freed from being depressed as in this figure, the seat is urged forward past its vertical position and lowered in turn by its weight and the action of a dashpot to move at a controlled speed into resting on top of the toilet bowl rim as shown in FIG. 1.

Figure 5:
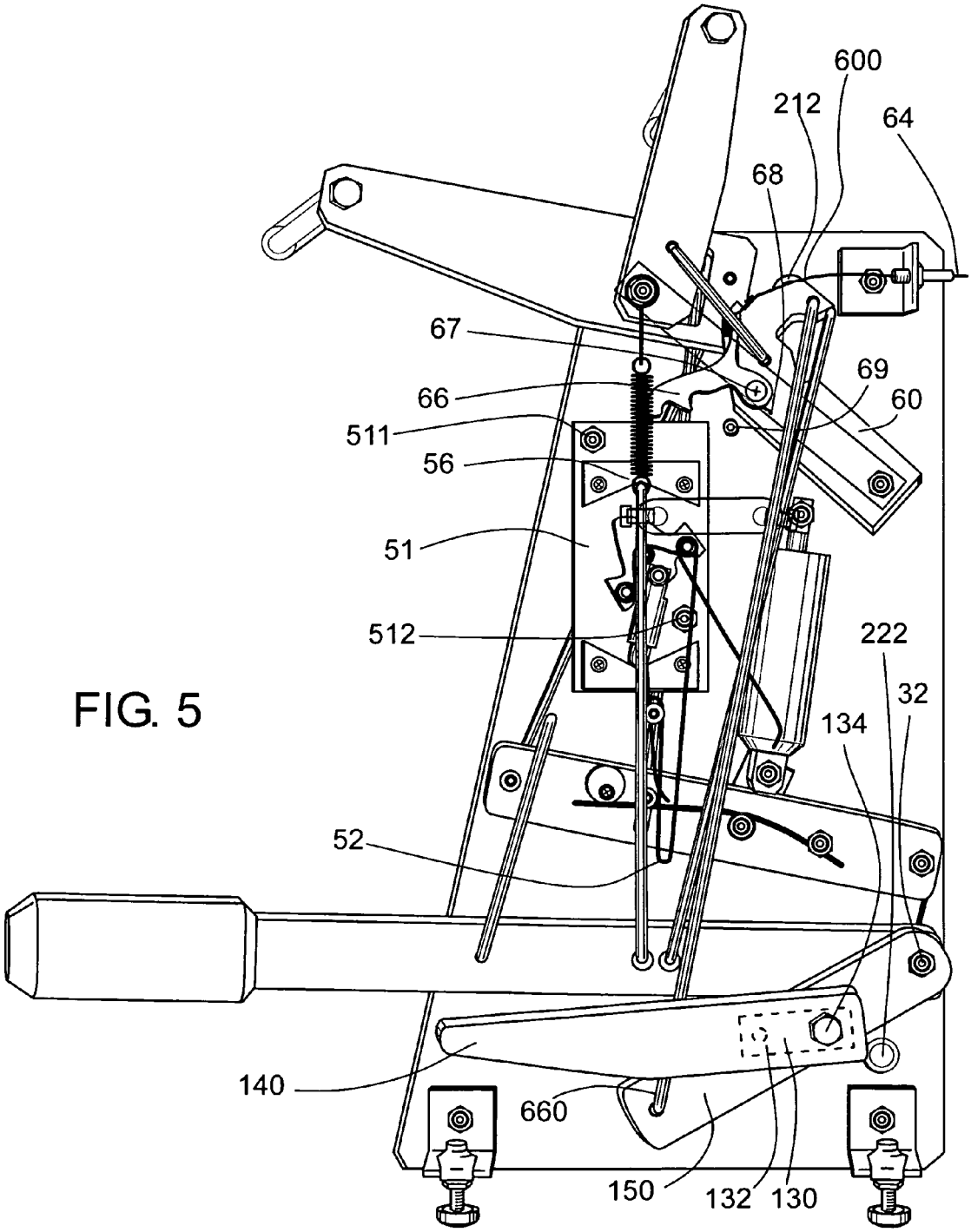

FIG. 5 shows a secondary pedal being depressed into its lowest position in the operation of flushing only and not disturbing the seat which is resting in the lower position.

Figure 6:
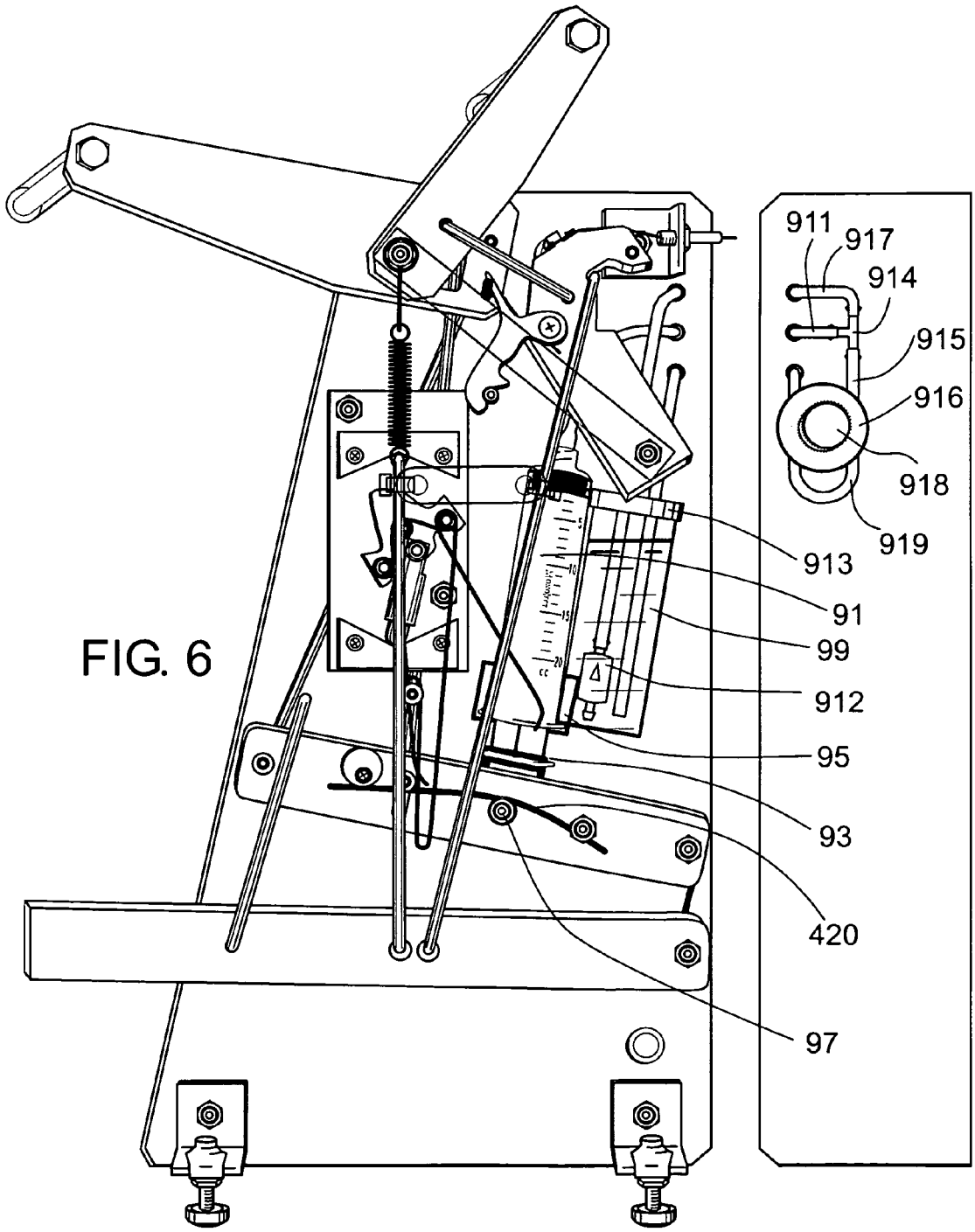

FIG. 6 shows a type of conveniently adjustable dashpot realizable quickly and inexpensively with currently available components.

Figure 7:
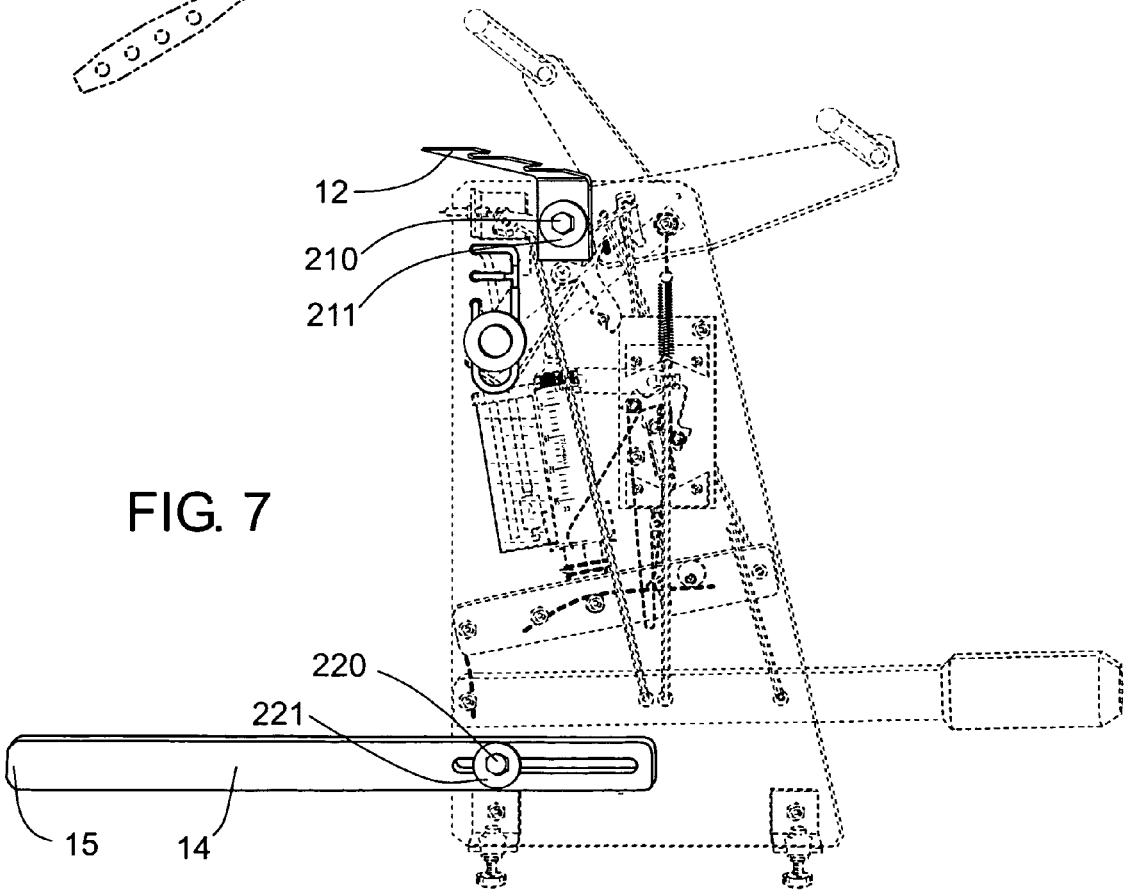

FIG. 7 shows the components contemplated for the basic embodiment in solid lines on the back of the base plate, and everything else in hidden lines; some components being removed for clarity.

Figure 8:
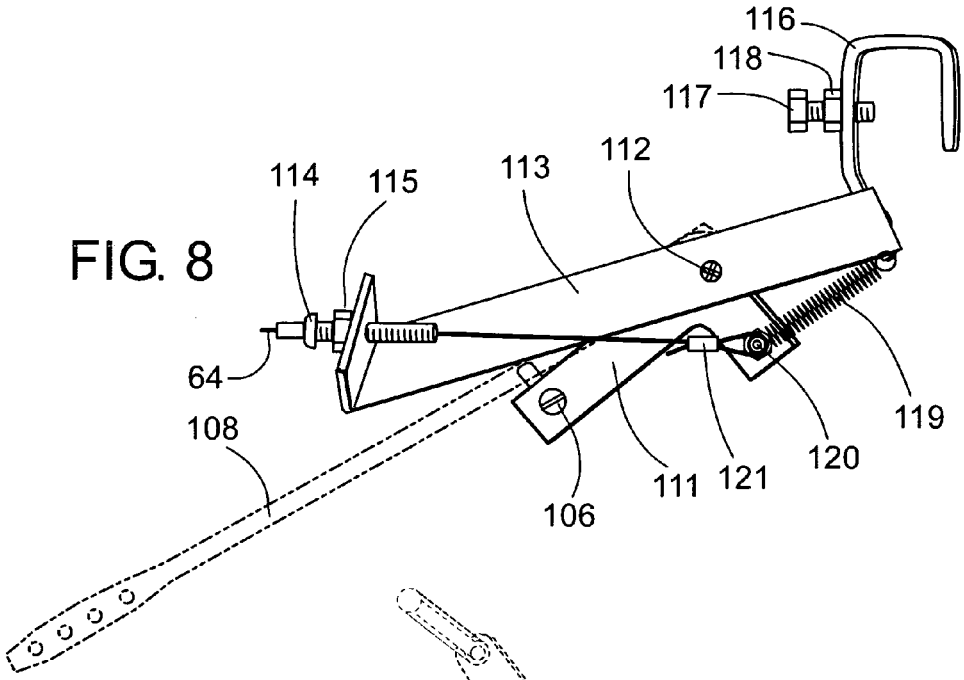

FIG. 8 shows the basic assembly to be mounted quickly and snuggly inside of the toilet water tank to cooperate with the main body of the embodiment standing on the floor in the flushing of the toilet at the right time.

Figure 9:
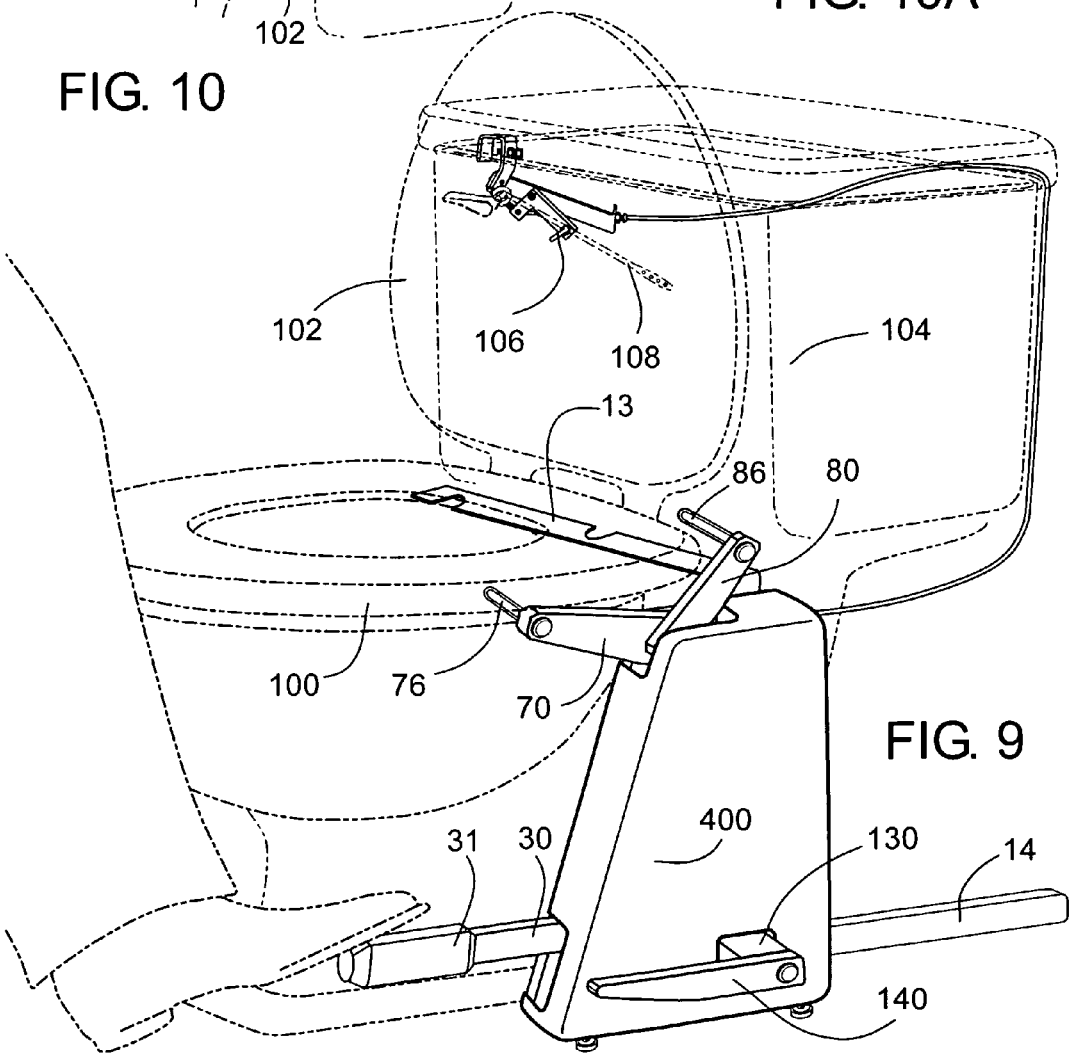

FIG. 9 shows the general look of the embodiment for a medium size of toilet bowl of the standardized range of rim height from 14 to 15 inches.

Figure 10:
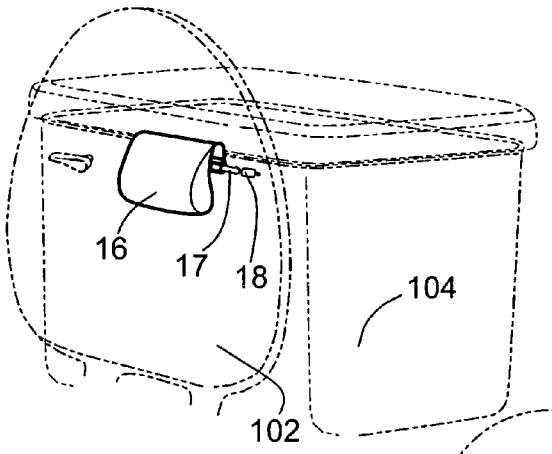

FIG. 10 shows one form of accessories that correctly dampens the potential impact noise and vibrations of the seat against its lid that impacts in turn onto the water tank.

Figure 10A:
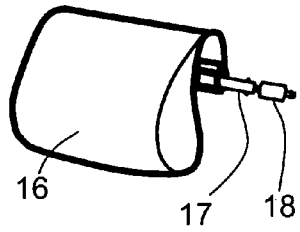

FIG. 10A shows a magnified form of accessories shown in FIG. 10.

Figure 11:
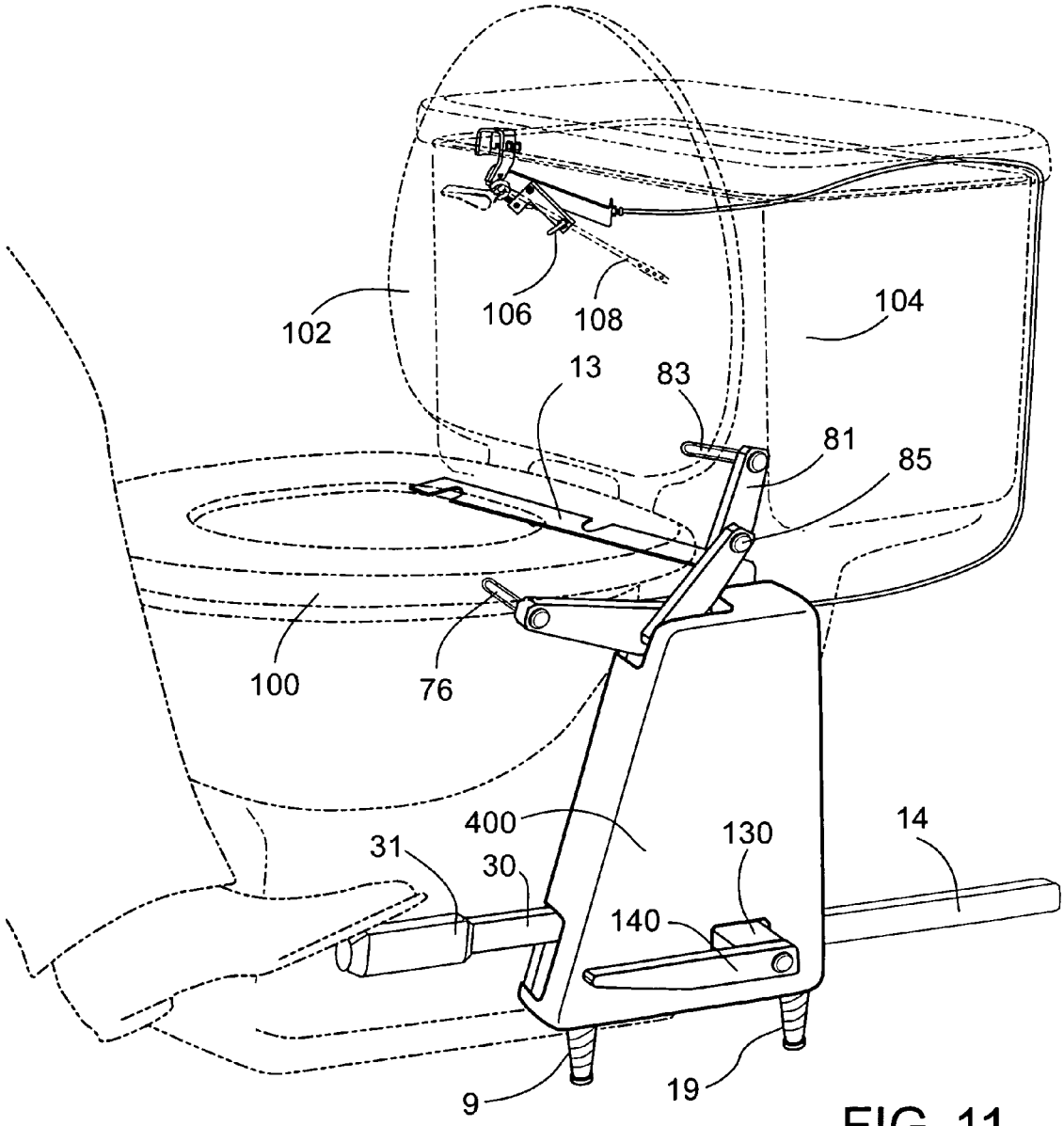

FIG. 11 shows the general look of the embodiment for a medium-size toilet bowl of the standardized range of rim height from 16 to 17 inches.

Figure 12:
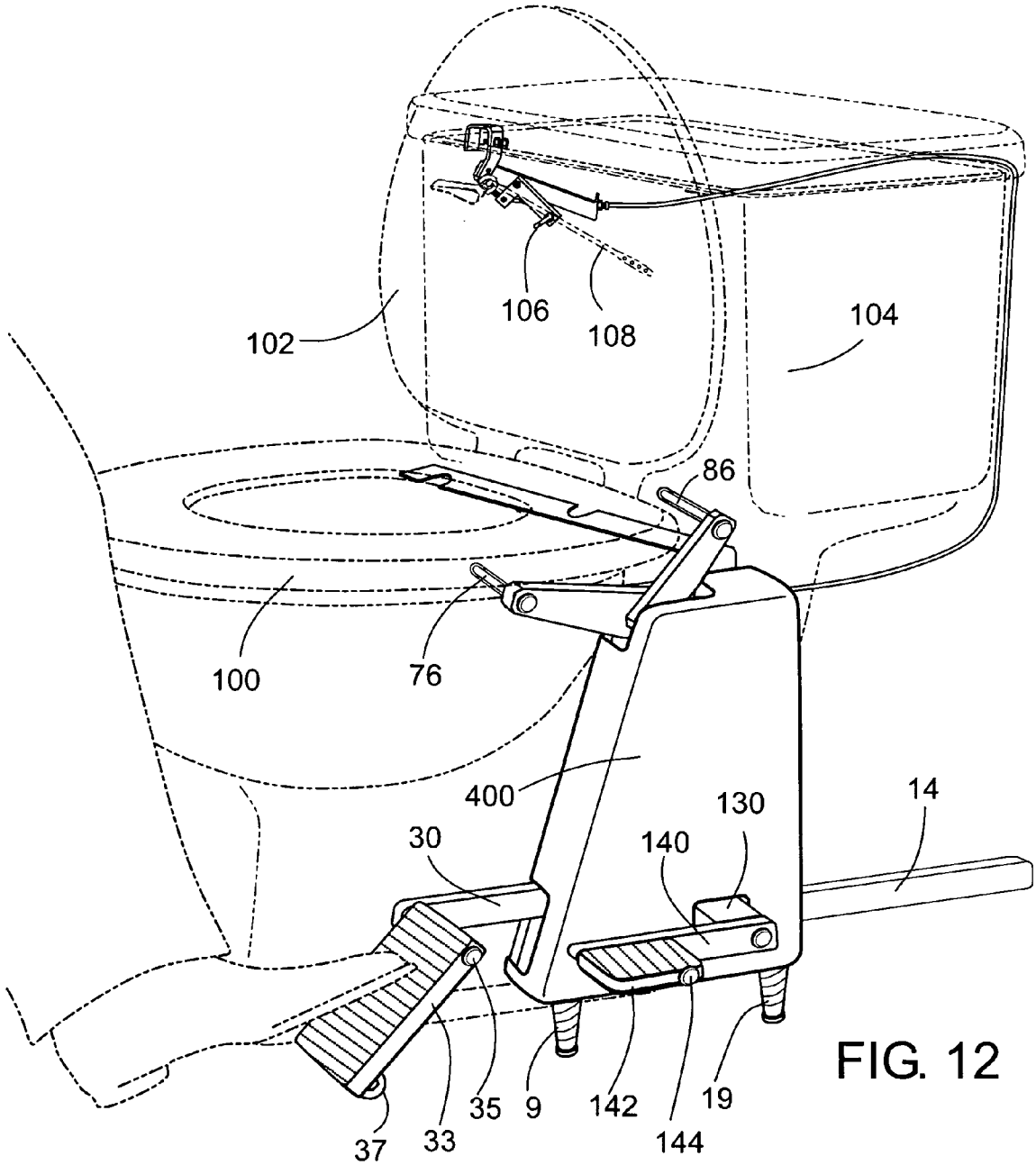

FIG. 12 shows the general look of the embodiment for a medium-size toilet bowl of the standardized range of rim height from 16 to 17 inches, with enlarged pedal areas for potential use of special-need people.

DETAILED DESCRIPTION

First Embodiment

For clarity in the detailed description the following definitions are adopted:

A toilet system on which an embodiment of this application is put into use has as existing equipment the following:

(a) a toilet bowl, with a rim on top, and with rim height, or toilet height, defined as the distance from the top of the rim of a toilet bowl to a mounting surface, standardized in definite ranges;

(b) a toilet seat 100, sometimes abbreviated as a seat 100, attached conventionally to swivel up vertically and down horizontally, on top of the toilet bowl through standardized apertures on the toilet bowl with predetermined nuts and bolts;

(c) a water tank 104, having a tank container with a flat surrounding-wall top, sometimes abbreviated as a tank top; a tank cover; a flushing mechanism actuated with a flushing rod 108 inside the tank container; and a flushing lever outside of the tank container; for the conventional flushing of the toilet bowl;

(d) a toilet-seat lid 102, sometime abbreviated as a lid 102, attached conventionally to swivel up vertically to rest against the water tank and down horizontally to rest on top of seat 100, along seat 100 or independently of seat 100 when possible; and (e) a wall behind said toilet bowl.

Figure 2:
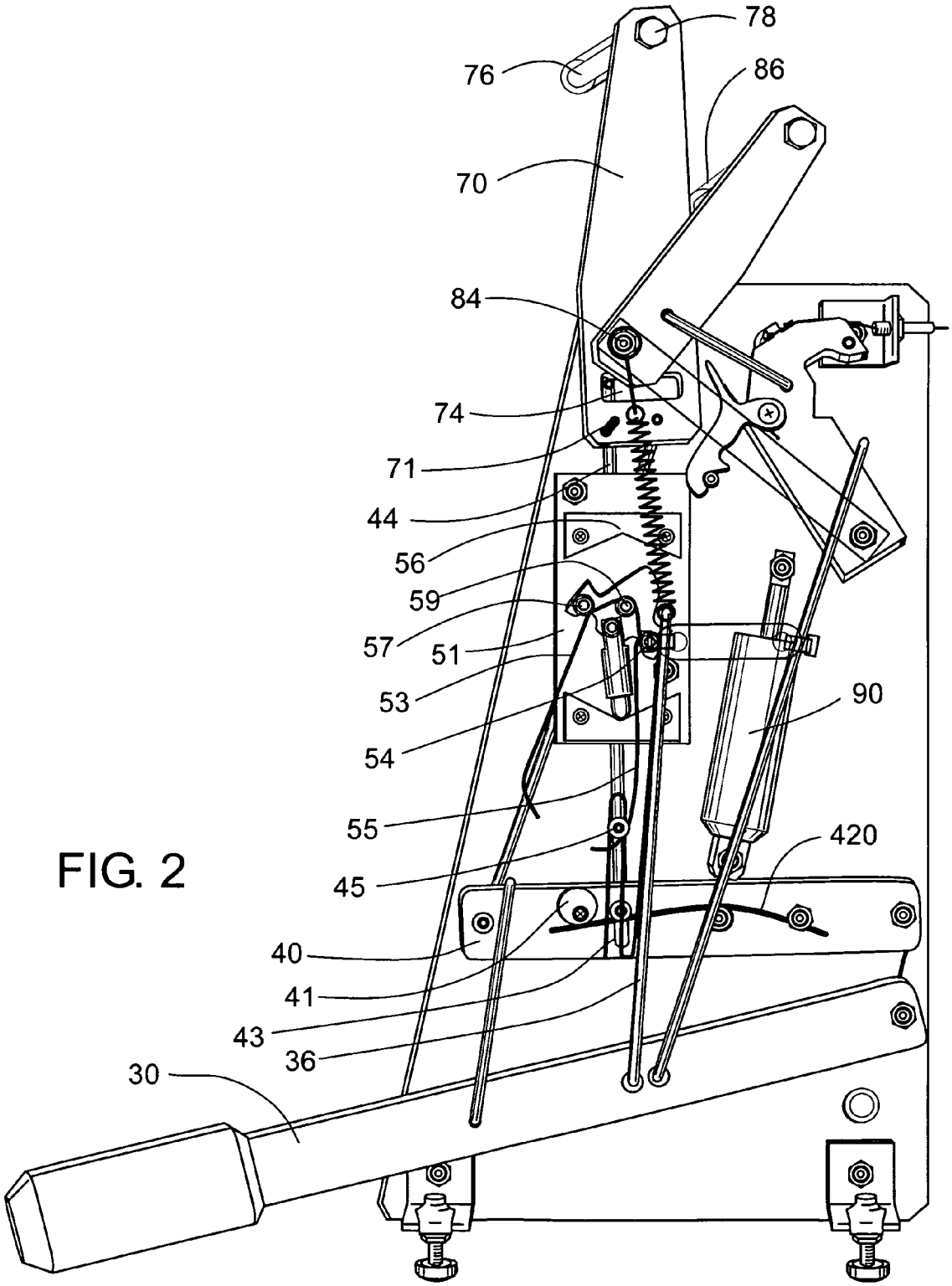
FIG. 2 shows the embodiment with the pedal being depressed to its lowest position in the operation designed to raise the seat.
Figures 3, 3A:
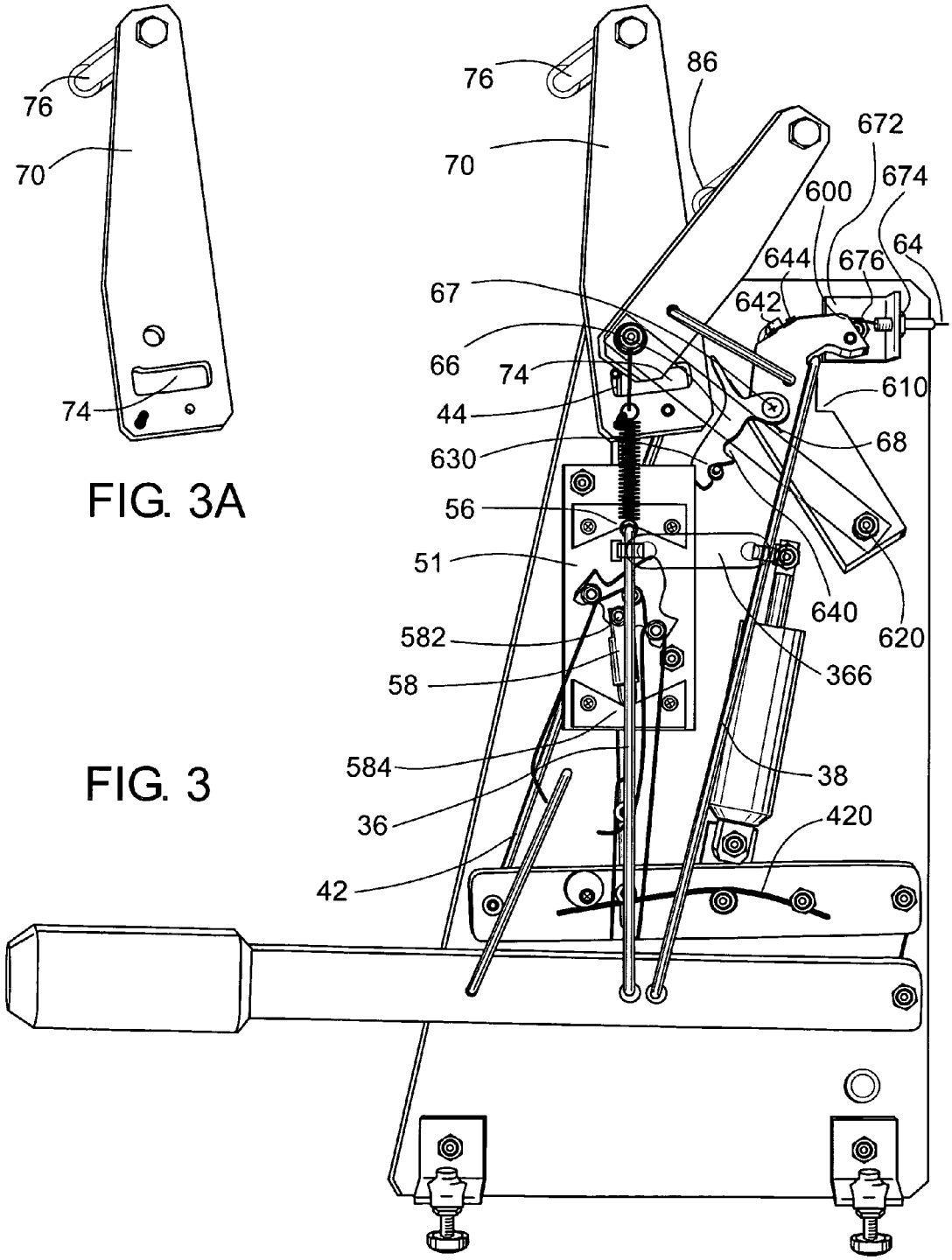
FIG. 3 shows the embodiment in the situation where the pedal has been freed from being depressed and the seat has been raised past its vertical position to rest against the lid, which in turn rests against the front part of the toilet water tank.
FIG. 3A shows the details of the cut out area hidden in FIG. 3.

The details of the mechanism of one embodiment of the hands-free toilet attachment are illustrated in FIGS. 1-12. A same part in any of these figures is labeled with a unique number, and if a label is repeated in a different figure, it is for the purpose of looking at the part in a clearer context. In the following description, before large production runs using injection moldings, unless specifically mentioned, all plastic parts are machined preferably from widely available flat panels of half-inch thickness of high-density polyethylene (HDPE). All metal rods are preferably made out of stainless-steel-rod stock of 5/32" diameter. All wire forms and torsional or extension springs are preferably made of stainless-steel wires of predetermined diameter and strength. Unless specifically mentioned, all screws are stainless-steel, 10-32, Phillips pan head screws of predetermined length; and bolts are stainless-steel, ¼-20, hex head bolts of predetermined length. The preference for these items is dictated by mechanical, aesthetic, and economic reasons. The mechanism of the embodiment includes:

a base plate 20, serving as a planar member having paralleled, opposed major faces, supporting mechanical linkage for the cooperating elements;

a plastic foot pedal 30 pivoting at one of its ends on a plan parallel to supporting base plate 20, around a first axis 32 made out of a screw mounted normal to the opposed major faces of base plate 20; foot pedal 30 being fitted snuggly at its free end with a thick-wall silicone tubing 31 as a simple, aesthetic and friendly area for foot pedaling (see FIG. 9);

a first U-shaped metal rod 34 transmitting the pedal 30 movements onto a plastic first lever 40 on the swinging down movement only, while detaching itself from this first lever 40 during the time pedal 30 swings up; rod 34 being stabilized on first lever 40 with a nylon cable tie (not shown);

a second U-shaped metal rod 38 transmitting the pedal 30 movements onto a plastic first arm 60 of a mechanical toggle serving as a memory of the transient period when toilet seat 100 is urged to be falling down;

a third U-shaped metal rod 62 serving as a second arm of the mechanical toggle, and transmitting the movements of first arm 60 of the mechanical toggle onto a fulcrum 82 on a plastic third lever 80 which rotates on an axis 84; axis 84 being made out of a screw mounted normal to the opposed major faces of base plate 20;

a fourth and fifth U-shaped metal rods 42 and 44 transmitting the movements of first lever 40 onto a well-defined aperture 72 and a well defined cut out area 74 of a plastic second lever 70, respectively; FIG. 3A showing the details of cut out area 74 hidden from view in FIG. 3 and others; second lever 70 rotating on the same axis 84 as third lever 70;

a mechanical flip-flop 50, operating on its support plate 51 which is attached onto base plate 20 with two screws 511 and 512;

a sixth U-shaped metal rod 36 transmitting the pedal 30 movements onto mechanical flip-flop 50, that is preferably made of acetal, and that serves as a memory of the state, up or down, of toilet seat 100 seen in FIG. 9; mechanical flip-flop 50 having two L-shape wire forms 53 and 55 (see FIG. 2) attached to it with two anchors 54 and 57 made out preferably of two stainless-steel, 4-40, pan head screws of predetermined length mounted normal to the two parallel major surfaces of flip-flop 50 along with adequate numbers of washers and lock nuts; one end of each wire forms 53 and 55 is attached to a fifth axis 59 of flip-flop 50 (see FIG. 2); axis 59 being made preferably of a stainless-steel, 4-40, pan head screws of predetermined length mounted normal to the two parallel major surfaces of the support plate 51 of flip-flop 50 along with adequate numbers of washers and lock nuts; wire forms 53 and 55 being allowed to rotate freely around anchors 57 and 54, respectively, to move to the left or right in FIG. 2, via their remaining ends, the tip 45 of a short rod that is brazed perpendicularly at a chosen point onto rod 44; in the process, wire forms 53 and 55 constitute with tip 45 a means to push the tip of rod 44 to one or the other of two limiting positions according to the memory in flip-flop 50;

a first torsional spring 46 that wraps around the axis 48 of first lever 40 which is made out of a screw mounted normal to the opposed major faces of base plate 20; torsional spring 46 being biased to urge first lever 40, when free, to swing upward after first lever 40 is pulled downward by foot pedal 30, for the purpose of latching seat 100 into a stable position leaning against lid 102, in front of water tank 104 (see FIG. 9), in well-designed cooperation with the upper end of fifth U-shaped metal rod 44; also, torsional spring 46 is there for the purpose of moving the upper end of fifth U-shaped metal rod 44, at the right time, into freeing second lever 70 for it to rotate away from the underside of seat 100;

a second torsional spring 420 on first lever 40 that bears against the lower end 422 (see FIG. 1) of fifth U-shaped metal rod 44 to cooperate in a predetermined manner with second lever 70 to accommodate harmlessly an inadvertent manual lowering of seat 100 when it has been latched in the raised position, helping to safeguard the mechanism against damages; the manner of cooperation with second lever 70 in this process being executed by, referring to FIG. 3, the fact that when second lever 70 rotates counterclockwise by the manual lowering of seat 100, the whole rod 44 is pushed down continuously onto torsional spring 420 until the upper tip of rod 44 swings past the straight line between axis 84 and apex 56, then the whole rod 44 is freed to be pushed up forcefully by torsional spring 420 to go rest eventually at its topmost position again; the action of torsional spring 420 on the lower tip of rod 44 being made more reliable with a collar 451 (see FIG. 1) fastened with a set screw onto the very ending of the lower tip of rod 44; collars similar to collar 451 being strategically affixed on other tips of rods 45 and 42 (see FIG. 1) and of other rods (not shown);

a metal Z-shaped wire form 52 (seen in FIGS. 1-5, more clearly in FIGS. 4-5) anchored on anchor 54 of flip-flop 50 to serve, when seat 100 or the combination of seat 100 and lid 102 is being lowered, to secure the reset of flip-flop 50 for correctly raising seat 100 or the combination of seat 100 and lid 102 the next subsequent time when foot pedal 30 is depressed, if the seat lowering operation has caused any disturbance in the flip-flop memory, for instance, by a concurrent flushing action, or by an inadvertent lowering of seat 100 by hand after it has been latched in the up position; Z-shaped wire form 52 performs assiduously the reset of flip-flop 50 to its initial state depicted in FIG. 1; every time first lever 40 is caused to move from its lowest to its highest position for seat lowering, intentionally or inadvertently, lever 40 would cause tip 45 to push up one of the Z bends, and relatedly, all of Z-shaped wire form 52 till the point when flip-flop 50 would suddenly snap into a final state of memory, thanks to the snap action of spring housing 58;

a rolling pin 76, made of predetermined element including acetal, preferably of a nylon bolt of predetermined size, preferably of the type ¼-20 of 3.5" to 4" of length, that rolls freely but snuggly (with as little a play as possible) inside an aperture 78 on second lever 70 and covered all around its part outside of aperture 78 with a semi-rigid plastic tubing preferably of polypropylene or polyethylene;

a rolling pin 86, made of predetermined element including acetal, preferably of a nylon bolt of predetermined size, preferably of the type ¼-20 of 3.5" to 4" of length, that rolls freely but snuggly (with as little a play as possible) inside an aperture 88 on third lever 80 and covered all around its part outside of aperture 88 with a semi-rigid plastic tubing preferably of polypropylene or polyethylene;

an extension spring 362 attached to the upper end of a sixth U-shaped rod 36 and to the lower end of a J-shaped wire form 364 (see FIG. 1); the upper end of J-shaped wire form 364 being attached to the axis 84 common to second and third levers 70 and 80; spring 362 being biased to pull the upper end of rod 36 toward axis 84 to rest at the apex 56 of the flip-flop support plate 51 (see FIGS. 2-5);

a plastic first link strip 366 (see FIG. 2) made preferably of acetal, attached at its two ends with nylon tying straps of predetermined strength to the upper end of rod 36 and to a predetermined point of rod 38; first link strip 366 serving as a mechanical linkage that maintains rods 36 and 38 in a rigid angular position with respect to each other in all their movements;

a conventionally-designed dashpot 90 (see FIG. 1-5) that can be manufactured industrially as a shortened version (with same diameter but without the internal spring) of a preferably (due to relatively short travel involved) hydraulic dashpot often seen conventionally attached to a storm door to slow down the closing of such door after it has been opened; dashpot 90 being attached to first lever 40 at its lower end with screw 92 and bracket 94 of metal or acetal; dashpot 90's lower end moving up and down along with first lever 40; the upper end of dashpot 90 being attached to a screw 96 mounted normal to the opposed major faces of base plate 20, and allowed to rotate around screw 96 when first lever 40 moves up or down; dashpot 90 being adjustable in its speed-slowing control by conventionally rotating in one direction or the other its cylindrical body around its two end anchors;

an upper bracket 12 (see FIG. 7, FIG. 9 and FIGS. 11-12) to be installed on top of the toilet bowl rim at the conventionally provided standardized apertures that would accept the bolts and nuts that would hold a seat down onto the back area of the toilet bowl rim; upper bracket 12 being attached on the back side of base plate 20 by way of a stainless-steel T-nut on base plate 20 and a ¼-20 hex bolt; the design of upper bracket 12 benefiting from the standardized distance between and size of the two apertures for toilet seat attachment onto the toilet bowl rim;

a lower bracket 14 (see FIG. 7, FIG. 9 and FIGS. 11-12) having a free end 15 bearing snuggly against the wall surface on the back side of the toilet bowl to counter efficiently a disturbing force component that acts on the embodiment each time pedal 30 is depressed; lower bracket 14 being attachable on the back side of base plate 20 as seen in FIG. 7 by way of a stainless-steel T-nut 222 (shown only in FIG. 5) on base plate 20 and a hex bolt 220 and a flat washer 221 and possibly some lock washers (not shown); the design of lower bracket 14 benefiting from the modern-time standardized rough—in which is defined as the distance from the wall to the center of the toilet drain hole (about 12" for about 95% of toilets nowadays, according to certain statistics of the industry); lower bracket 14 being made preferably out of acrylic sheet material of the right thickness for a transparent, barely visible appearance on the embodiment to enhance the visual aesthetics and also for its longish oblong cutout (shown on FIG. 7) to be cut efficiently by laser machining in the fabrication process;

a supporting foot 1 composing of a L-shape bracket 3 that is attached onto base plate 20 with a screw 4 with washers and lock nut (not shown); bracket 3 being equipped with a U-nut 5 that will receive a hex bolt 6 that is covered on its hex head with a mating decorative plastic cap 8; full-thread hex bolt 6 being of a length about 3.5" to help the embodiment accommodate all toilet bowl rim heights from 14" to 17" easily (see also FIGS. 11-12); hex bolt 6 being surrounded by an extensible spiral cone 9 (see FIGS. 11-12);

a supporting foot 2 (see FIG. 1) with its hex bolt (not shown) surrounded by an extensible spiral cone 19 (see FIGS. 11-12), made similarly to supporting foot 1.

Operation—FIGS. 1-12

Second lever 70 rotates around axis 84 that is made roughly parallel (but not necessarily on the same straight line) to the axis of the toilet seat, and equipped with rolling pin 76 at one of its ends to bear on the under side of toilet seat 100 (see FIG. 9). In FIG. 1, flip-flop 50 is seen, with its top tilting to the left, as remembering the down state of toilet seat 100. Referring to FIG. 2, pedal 30 is seen depressed to its lowest position for the purpose of raising seat 100. In the process, first lever 40 being depressed along with pedal 30, actuates via rod 42 to rotate clockwise second lever 70 which causes in turn rolling pin 76 to push up the underside of seat 100 to make it rotate its gravity center past the vertical line and makes seat 100 rest steadily against lid 102 (see FIGS. 2-3 and FIG. 9). Concurrently in the same process, the tip of rod 36 pulls the top of flip-flop 50 to the right in FIG. 2 and causes wire form 55 to push tip 45 and relatedly the upper tip of rod 44, to the left of the figure. In FIG. 2 as a time-frozen picture of the mechanism of the embodiment, it is seen that there is a systematic gap between the upper tip of rod 44 and a half-circular part of cut out area 74 of second lever 70 (see FIG. 3A). Also in the same process, first lever 40 causes dashpot 90 to be extended in the way that makes its fluid flow quickly from a first chamber to a second one, as per design. Clearly visible in FIG. 2, a cylindrical eccentric 41 is tightened up, after adjustments, onto first lever 40 to help rod 44 to rotate freely around its lower end in an elongated oblong aperture 43 of first lever 40. Torsional spring 420 is designed to bear forcefully against lower end of rod 44, when the lower end of rod 44 is pushed down further than the limit allowed by eccentric 41.

FIG. 3 can be considered as a time-frozen picture of the mechanism of the embodiment taken after foot pedal 30 has been released from its depressed position. The upper tip of rod 36 is pulled up and guided to rest in apex 56. Flip-flop 50 is seen, with its top resting tilted to the right, as remembering the up state of toilet seat 100. This memorized state of flip-flop 50 is the consequence of the action of the tip of rod 36 described in FIG. 2, along with the systematic snap action of a cylindrical telescoping housing 58 of a predetermined compression spring (not shown) that is designed to expand the length of housing 58 that is limited between an axis 582 on flip-flop 50 and an apex 584 on the support plate 51 of flip-flop 50, when free to do so, after being compressed. The length of housing 58 was compressed briefly in FIG. 2 when axis 582 on flip-flop 50 was made to swing into line with the straight line between axis 59 and apex 584 (see FIGS. 2-3). Axis 582 is made of a stainless-steel, 4-40, pan head screw of predetermined length mounted normal to the two parallel major surfaces of flip-flop 50 along with adequate numbers of washers and lock nuts. The top of housing 58 is designed to systematically push efficiently and securely against axis 582 along a straight line passing roughly by equal distances between the two parallel major surfaces of flip-flop 50. FIG. 3 shows also, by design, first lever 40 swinging up a little bit from its position in FIG. 2. In the process, second lever 70 is caused to rotate a designed little amount counterclockwise in FIG. 3 to make the half-circular part of cut out area 74 to rest steadily on top of the upper tip of rod 44 which moved up a designed little distance with the action of first lever 40 (see also FIG. 3A).

FIG. 4 can be considered as a time-frozen picture of the mechanism of the embodiment taken after foot pedal 30 has been depressed into its lowest position for the purpose of lowering seat 100, at a time sequentially happening, as per design, after the immediately preceding time happening after foot pedal 30 had been depressed into its lowest position for the purpose of raising seat 100 and then released. Following the going down movement of pedal 30, the memorized state of flip-flop 50 as described in FIG. 3 causes systematically the tip of rod 36 to pull the top of flip-flop 50 to the left in FIG. 4 for it to remain there thanks to the snap action of housing 58. In the process, first lever 40 and relatedly rods 42 and 44 move down a designed little distance to free the tip of rod 44 from the lateral constrain of the half-circular part of cut out area 74 and to cause first lever 70 to rotate clockwise a designed little amount (see also FIG. 3A). Concurrently in the same process, the tip of rod 36 pulls the top of flip-flop 50 to the left in FIG. 4 and causes wire form 53 to push tip 45 and relatedly the upper tip of rod 44, to the right of the figure, past the straight line between axis 84 and apex 56. Also in the same process, the tip of rod 36 moves on a contour that guides rigidly, via first link strip 366, the upper tip of rod 38 into engaging intimately with triangular cutout 610 of first arm 60 of the mechanical toggle (see FIG. 3). Observable in FIGS. 3-4, after the engagement with cutout 610, the upper tip of rod 38 can move only through a circular-arc trip defined by cutout 610 around an axis 620 of first arm 60 of the mechanical toggle. This circular-arc trip compels, by virtue of said first link strip, the tip of rod 36 to move along another circular-arc trip, by design, on a contour of flip-flop 50, in the process of pulling the top of flip-flop 50 to the left in FIG. 4. At the end of this circular-arc trip as depicted in FIG. 4, metal rod 62 that serves as a second arm of the mechanical toggle goes into toggling state and pushes third lever 80 and relatedly rolling pin 86 (seen more clearly in FIGS. 1-3 and invisible in FIG. 4) to the left in FIG. 4. Rolling pins 86 and 76 are strategically made to be pliable. All things related to rod 62, including its anchoring apertures on first arm 60 and third lever 80, are designed so that in the toggling state, rolling pin 86 will push the top of seat 100 forward forcefully as far as possible, even to the point of bending, within acceptable limits, rolling pin 86 against an edge of second lever 70 as can be virtually visualized in FIG. 4. The bottom of seat 100, in turn, is pushed hard against the rolling pin 76 which can bend temporarily within acceptable limits to accommodate obligingly the action on seat 100. Rolling pins 76 and 86 can be considered as part of the basic hardware of the raising and lowering means for seat 100 alone or seat 100 and lid 102 together, in conceivably different combinations.

Experimental testing a prototype of the embodiment shows that repeatedly done, the toggling action, when made necessarily forceful for reliable operations, has a deleterious effect on the integrity of the toggle structure, as the tips of axes 84 and 620 would sooner or later get bent away permanently badly from each other after a certain number of operations involving the toggle, namely lowering the seat 100. Therefore, a plastic second link strip 200, pictured as made of transparent material in FIGS. 1-6, but preferably made of acetal, is precisely designed to be tightened onto the tips of axes 84 and 620 to maintain easily the initially designed distance between the tips of these axes 84 and 620. Second link strip 200 proves to make the toggle integrity immune to the expected number of toggling states, and thus will be adopted as a part of the embodiment. FIG. 3 shows the beginning position while FIG. 4 shows the ending position of a chosen point 600 on first arm 60 in its travel course, also a circular-arc trip, when cutout 610 is forced to move through its circular-arc trip by the up-to-down action of pedal 30 on rod 38.

The circular-arc trip of point 600 (see FIGS. 3-4) on first arm 60 is used very efficiently to pull a properly anchored sheathed cable 64 (see FIGS. 3-4) to cooperate with a linkage rod 106 (see FIGS. 8-9) that pushes up flushing rod 108 (see FIGS. 8-9) inside toilet water tank 104 to flush reliably the toilet every time first arm 60 of the toggle is moved through the just-described arc by the foot action for lowering the seat by the embodiment, or by another action. Sheathed cable 64 being made preferably of stainless-steel cable enrobed in nylon, is anchored onto base plate 20 with a corner 672 made of metal or acetal, a fitting sleeve 674 commercially available in predetermined wall thickness in polypropylene, and a screw 676. A first crimped loop 644 of cable 64 is hooked around a nip 642 on first arm 60. Linkage rod 106 is preferably made of a ¼-20 nylon, pan head screw affixed onto an L-shape bracket 111 made out of ¼" thickness HDPE or acetal that rotate freely around a screw 112 located on a contoured assembly 113. Assembly 113 includes: a properly step-drilled ¼-20 nylon screw 114 with jam nut 115; a U-shaped bending 116 with a ¼-20 nylon hex bolt 117 with jam nut 118; an extension spring 119 that pulls on a screw 120. Screw 120 with predetermined numbers of washers and lock nuts also serves as a hook to a second crimped loop 121 of cable 64. Assembly 113 is designed to be attached quickly and securely on the tank top of water tank 104 at a strategically chosen location for linkage rod 106 to push up efficiently flushing rod 108 (see FIGS. 8-9), before the water tank cover is put back on to stabilize itself with the extra thickness on the tank top of around 3/16" of U-shaped bending 116 thickness at one part of the tank top of the water tank 104, and the diameter of the sheath of cable 64 on another part of the tank top of water tank, as seen in FIG. 9 and FIGS. 11-12.

It is conceivable, from FIG. 8, that linkage rod 106 can be tailored as to be able to have a predetermined direction of movement selected from the group consisting of up, down, and a predetermined three-dimensional angle with respect to the vertical line passing by a point of the water tank (not shown), to serve as part of a means to actuate a component (not shown) of the flushing apparatus of the toilet system that ultimately would latch into the opening of an aperture to discharge quickly water in the tank for flushing in an apparatus that works with gravity, or conditioned pressure, in a single mode or dual mode in which the amount of discharged water varies according to which button among the two buttons to actuate.

When the depression on foot pedal 30 is released for subsequent actions, cable 64, due to the linkage to the flushing mechanism, exerts necessarily a toggle-disengaging action on first arm 60 when it is no longer held down by the depression on foot pedal 30. To help maintaining the toggling action on rolling pin 86 for further intended actions, a latching means is provided. This latching means includes a latch 66 attached onto first arm 60. Latch 66 (see FIGS. 1-4) is made of predetermined metal or acetal to rotate around a stainless-steel, 8-32, pan head screw 67 that is mounted normal to the parallel major surfaces of first arm 60 and secured in place with a lock nut (not shown); latch 66 being urged to rotate counterclockwise in FIGS. 3-5 by a torsional spring 68 that wraps around screw 67, and to rest on a screw 69 mounted normal to the opposed major faces of base plate 20 and sleeved preferably into a piece of semi-rigid plastic tubing of polypropylene or polyethylene. The preference of screw 67 to be 8-32 type is to minimize the number of drilling sizes on first arm 60. When latched into a position near or at the point of toggling action by latch 66 (see FIGS. 3-5), the mechanical toggle also serves as a memory of the transient period when toilet seat 100 is urged to be falling down.

In FIGS. 3-4 latch 66 is seen to have two essentially half-circular notches 630 and 640. In FIG. 3 latch 66 is seen as having its notch 630 rest on screw 69. In FIG. 4 latch 66 is seen as having been actuated by the up-to-down movement of pedal 30 to have screw 69 moving away, by motion of first arm 60, from notch 630 toward screw 67 past the position of notch 640. Seen clearly in FIG. 2 is a disengaging pin 71 attached strategically at a location on second lever 70. Pin 71 is preferably made of a stainless-steel, 8-32, flat head screw.

Referring to FIG. 4 it can be deduced that when pedal 30 is released from the depression, the upper tip of rod 36 will be guided to rest in apex 56; cable 64 will pull on first arm 60 to guide, in turn, latch 66 to latch its notch 640 onto screw 69 while maintaining the toggle action intact. Second lever 70 now is freed to rotate forward (counterclockwise in FIG. 4) initially under the action of the mechanical toggle on rolling pin 86 on the top of seat 100, then subsequently under the continuous gravity force on seat 100 until the complete lowering of seat 100 is done. As systematically designed, rolling pin 76 is forced to roll or move without rolling, along the bottom of seat 100 to cause second lever 70 to rotate also counterclockwise in FIG. 4 until the end of the lowering of seat 100. In the process, second lever 70 pulls first lever 40 to rotate upward and, in turn, to compress the length of dashpot 90 at a controlled speed for the purpose of avoiding slamming seat 100 with a great impact onto the rim of the toilet bowl. This controlled speed is supposed to be adjusted to the satisfaction of a user during the installation of the embodiment. This controlled speed is governed by the adjustable size of an orifice inside dashpot 90 (not shown) that allows the dashpot fluid to flow back slowly from the second to the first chamber (not shown) of dashpot 90.

From FIG. 4 it also can be deduced that in the course of rotating counterclockwise, second lever 70 causes disengaging pin 71 to be eventually in contact with a disengaging arm 650 of latch 66 and guides to disengage notch 640 from screw 69. In the final stage of the course of rotation of lever 70, notch 630 is guided into resting on screw 69 with the related resting position of first arm 60 as seen in FIG. 1.

With the flushing added in, this embodiment can be considered as a completely hands-free toilet attachment not only for the male users of a group to use during urination, but also for both male and female users of the toilet for defecation, albeit—unless manual clean wiping of the bowl with a piece of toilet paper is anticipated—with one eventually redundant operation of raising an already-lowered seat and lowering it again just for the hands-free flushing in the basic embodiment.

Additional Embodiments

With the basic embodiment in place, provisions can be made to include easily a secondary pedal 140 (see FIG. 5, FIG. 9 and FIG. 11) distinctly made smaller and positioned away from first foot pedal 30 for strictly actuating only first arm 60 of the toggle of the basic embodiment, via a seventh U-shaped rod 660, to flush the toilet any time without moving toilet seat 100 when it is already in the lowered position (see FIG. 5). FIG. 5 shows that when secondary pedal 140 is depressed, rod 660 causes first arm 60 to travel through the same course of circular-arc trip as caused to be done in FIG. 4. However, in FIG. 5, latch 66 is seen as swinging harmlessly around screw 67 without latching onto anything. Also seen in FIG. 5, second lever 80 would move forward with force, but would not act on anything.

It can be deduced from FIG. 5 that when secondary pedal 140 is released from being depressed, everything in the mechanism of the embodiment returns to the state seen in FIG. 1, which can be considered as one of the two consecutive states of seat 100.

It is noticeable in FIG. 9 that when the commercial version of the embodiment is fully assembled before installation onto upper bracket 13 and lower bracket 14, if contained in a package, it would require a substantial stacking height for the packaging container. Provisions are made for rolling pins 76 and 86, as well as secondary pedal 140 with its adjacent plastic stand-off 130 (visible in FIGS. 9 and 11 but in hidden lines in FIG. 5) to be assembled easily at the installation time to reduce the packaging container's stacking height to a minimum level. FIG. 5 shows also in hidden lines a pin 132 made out of a short metal rod to be on the full width of stand-off 130 but only on about ¾ width of secondary pedal 140 and a fourth lever 150 to lock it in after assembly. Pin 132 would help in making secondary pedal 140 stronger and its assembly more maintenance-free. FIG. 5 shows that fourth lever 150 rotates conveniently around the same axis 32 of pedal 30 and is attached to secondary pedal 140 with a hex screw 134.

The addition of secondary foot pedal 140 can make the embodiment highly marketable as an inexpensive, friendly and helpful hands-free toilet attachment for better sanitary practice—compared to automatic flushing systems that would or would not raise and/or lower the seat—not only for homes but also for public institutions such as hotels, hospitals, churches, restaurants, sport stadiums, highway rest stops etc. . . . for both men and women in common or in separate rest rooms.

FIG. 7 shows a novel design for an upper bracket 12 that allows the installation of this upper bracket to be done without having to remove the two sets of bolts and nuts and the seat completely as required before it is possible to insert an upper bracket processed with two circular apertures as in simplistic designs, for these two sets of bolts and nuts. As seen in FIG. 7, upper bracket 12 may be installed securely in place by easing out the tightening of the two sets of bolts and nuts for a gap of about 3/16" to be present between the bottom of the toilet seat fixtures (within which the two bolts are located) and the toilet bowl rim. The two half-oblong cutouts seen on bracket 12 can be aligned with the two cylindrical tubules of the toilet seat fixtures and then bracket 12 can be slided in a straight direction under the seat fixtures in a manner that makes the two half-oblong cutouts hug closely around the two cylindrical tubules of the toilet seat fixtures. The two sets of bolts and nuts can now be re-tightened to immobilize bracket 12 into the predetermined location. Upper bracket 12 will be attached onto base plate 20 with a hex bolt 210 and a flat washer 210 and possibly some lock washers (not shown) engaged into a T-nut 212 (shown only in FIG. 5).

FIG. 9 shows yet another novel design for an upper bracket 13 that allows the installation of this upper bracket to be done without having to remove the two sets of bolts and nuts and the seat completely, as achieved with the design of upper bracket 12. The two half-oblong cutouts on bracket 13 are in opposite sides of the bracket (see FIG. 9). After preparations as for bracket 12 before, bracket 13 can be slided in between the two cylindrical tubules of the toilet seat fixtures and then swung around to align the two half-oblong cutouts with the two cylindrical tubules of the toilet seat fixtures, and the installation of bracket 13 can be finished similarly to that for bracket 12.

It can be appreciated that the novel designs of brackets 12 and 13 can shave quite a few minutes of installation time. The design of bracket 13 has a further advantage in better holding power in immobilizing bracket 13 against the main force of each foot pedaling which tends to push the free end of bracket 13 (to be attached onto base plate 20) in the direction from front to back of the toilet bowl.

Alternative Embodiment

FIGS. 6-7 show a novel way of implementing quickly a better performing and less expensive specially-designed dashpot compared to a more conventional (but available only in millions quantity at acceptable costs) dashpot 90 as intended for the present invention. In FIG. 6 (with foot pedal 30 truncated for clarity), in the place of former dashpot 90 we now see a syringe 91 with luer, preferably of the 20 cc size, widely available without prescription, for veterinary injections (instead of a ready-made syringe, a predetermined cylindrical tube will do). The lower end of the plunger of syringe 91 can swivel and be attached rotatively onto first lever 40 with a bracket 93 of metal or acetal, and a screw 97 which is also used for torsional spring 420. The lower end of the cylindrical body of syringe 91 is attached onto a bracket 95 of metal or acetal that can swivel around a screw (not shown) mounted normal to the opposed major faces of base plate 20. The luer of syringe 91 is fitted with an industrially available barbed female luer that is in turn fitted onto a polyvinyl chloride (PVC) tubing 911 with internal diameter (ID) preferably of 1/8" standard. Attached with a nylon cable tie (not shown) to syringe 91 is a plastic bottle 99 with a twist cap 913 widely available for use in pharmaceutical dispensing. Twist cap 913 is provided with two apertures of around 3/16" for sleeving (with allowance for air leaking in and out of bottle 99 under pressure) into the inside bottom of bottle 99 two PVC tubings 915 and 917. PVC tubing 917 fits onto a barbed end of a plastic check valve 912 that is oriented to allow only one-way easy flow of a fluid of predetermined viscosity, preferably water, from the inside to the outside of bottle 99. All three PVC tubings 911, 915 and 917 exit the inside area of base plate 20 (which will be covered under an enclosure 400 in the commercial form of the embodiment) onto the back side area of base plate 20 (which will be freely reachable by a user of the commercial form of the embodiment). In commercial form, tubings 911 and 917 will fittingly hook readily onto a barbed T-connector 914; tubing 915 will come unhooked until the installation time. At installation time a user can fill bottle 99 with tab water through tubing 915. Tubing 915 is hooked fittingly onto T-connector 914, and then is bent into a half-oblong shape form 919 under a metal or nylon washer 916 (see FIG. 6). Washer 916 in turn will be made to press more or less, in a long-lasting controlled manner, on the two essentially straight branches of half-oblong shape form 919 by turning clockwise or counterclockwise a thumb screw 918 of 10-32 size into a T-nut (not shown) on base plate 20. At a certain time in the process, turning clockwise thumb screw 918 will reduce the speed of flow of water into bottle 99, and turning counterclockwise thumb screw 918 will increase the speed of flow of water into bottle 99. After installing a commercial form of the embodiment onto upper bracket 12 or 13 and lower bracket 14 according to provided instructions, and before attaching the flushing accessory onto the tank top (placing it, for instance, on the floor for it to move its components freely), a user can turn thumb screw 918 clockwise all the way in until feeling that it is finger tight. This is to insure that the initial trial speed in going down of toilet seat 100 is the slowest. The user then can depress pedal 30 down to its lowest position to raise seat 100; remove the foot for pedal 30 to return up; then depress again pedal 30 down to its lowest position to lower seat 100; remove the foot for pedal 30 to return up again; and observe the going-down speed of seat 100. If the speed is too slow, a half-turn counterclockwise on thumb screw 918 and the trial can be repeated until the user's choice is satisfied along with a certain size and weight of seat 100. The speed control power of this remotely adjustable dashpot can be extended likewise to the more difficult case where the user prefers to raise or lower both seat and lid together out of safety concerns for kids and pets. As described, one can see that compared to any known commercially available dashpot, this novel dashpot has all the technical and economic advantages: low cost, short time-to-market, quick installation, no-leak in transit, and last but not least, remote adjustability.

Another Embodiment

One additional novel damping element can be added to the basic embodiment for potential users who want to use the present invention but insist on continuing to use their cherished toilet seats and lids made out of very heavy and hard materials. They have raised and lowered such seats gingerly by hand up until now, to avoid very hard slamming noise against the toilet water tank and bowl rim.

This novel damping element is a pouch 16 designed in a shape form as seen in FIGS. 10-10A, and made out of durable and pliable plastic such as PVC or polypropylene film of the predetermined thickness and pliability, containing a fluid of predetermined viscosity including petroleum jelly, but, preferably water. As shown in FIGS. 10-10A, the pouch can be made by cutting the plastic film into form, then air-tight sealing all the seams with heat-and-pressure tools along with a tubing 17, of PVC or polypropylene, preferably PVC, of about 1/8" ID as the only conduit for fluid exchange between the pouch inside and outside. Tubing 17 is pierced strategically with a plurality of pin holes on a location around 3/4" from its free end. The number and size of these pin holes will be determined with experiments before production decisions.

Pouch 16 is then fill with enough tab water through tubing 17 to cause its lower part to bulge out, when free, by design and by gravity force on the water inside pouch 16, while its top part is still filled with air at atmospheric pressure as per design. Finally, the free end of tubing 17 is hooked fittingly onto a barbed end of a plastic check valve 18 in the direction that causes valve 18 to prevent a fluid (water or air) from going from the outside to the inside of pouch 16, and to allow easy flowing in the reverse direction. The sealing seam around plastic tubing 17 may be used efficaciously as a means of attaching pouch 16 in front of water tank 104. Properly contoured in commercial form and attached on the water tank, when impacted upon by a lid 102 due to movement of seat 100 at the end of the raising of seat 100, or of seat 100 and lid 102 (see in FIG. 10), pouch 16 would flatten itself quickly by distributing water more evenly throughout its vertical volume. The design is to soften the impact systematically by allowing the top of the lid to be in contact only with the contour of the pouch but not with any part of the water tank, displacing air quickly, by virtue of the check valve, from the inside to the outside of the pouch on impact. After an impact, the pressure on the pouch is reduced physically. The design allows the water to redistribute itself then naturally by gravity inside of pouch 16 at a controlled speed, by drawing the just-displaced air back to the inside of pouch 16 only through the aforementioned pin holes on tubing 17, now that check valve 18 is shut tight by design.

An alternative simple way is to make tubing 17 long enough to dip into the water in the area near the bottom of the water tank. Pouch 16, second check valve 18 and another plurality of pin holes will do as well a job in the critical damping with mostly water.

As described, this accessory proves to be a simple, inexpensive, elegant and definitively correct engineering solution to the problem of critically damping the impact noise and vibrations of a toilet seat (or seat and lid) when raised to stay in the open position leaning against the front part of the water tank.

Other Alternative Embodiments

In FIG. 9 and FIGS. 11-12 all hex bolt heads are shown covered with commercially available mating decorative plastic caps.

FIG. 11 shows an extension lever 81 to be used in the case where a user prefers to raise or lower both seat and lid together. When purchased as an accessory for any toilet rim height, extension lever 81 will install the rolling pin assembly that is supposed to take the place of rolling pin 86 in the basic embodiment as a new rolling pin 83 on an aperture provided on extension lever 81; and extension lever 81 will be in turn installed onto third lever 80 with the help of an aperture on lever 81 (not shown) and an aperture on lever 80 (not shown) formerly provided for rolling pin 86, with a hex bolt 85 and its co-fastener (not shown). Extension lever 81 is designed to allow rolling ping 83 to act efficiently behind the top of lid 102 only when lid 102 is in the up position. At lowering time, both lid 102 and seat 100 are urged to move forward due to the depressing of pedal 30 and the correct memorized state in flip-flop 50 that sets rolling pin 83 into toggling action.

At raising time, it can be deduced from FIGS. 11-12 that rolling 76 will lift both seat 100 and lid 102 together. It is also understood that any type of dashpot of the embodiment shall be adjustable to an acceptable speed in the lowering process.

It goes without saying that, for large special orders for specific users who want strictly to raise and lower both seat and lid together, lever 80 can be made longer so as extension lever 81 would not be needed at all.

FIGS. 11-12 show also the prominently visible role of extensible spiral cones 9 and 19. Designed by an artist in stainless-steel preferably, these extensible spiral cones can make an embodiment of this invention aesthetically acceptable in many environments for all the different toilet rim heights from 14" to 17" of the available standards.

Referring to FIG. 5 and FIGS. 11-12, the reader can notice that all parts, except one, of the embodiment can be made exactly the same for the right or left side mounting of an embodiment. For an embodiment for left side mounting, these parts, including the base plate 20, will be assembled in a mirrored image of the embodiment illustrated in FIG. 5 which is intended for right side mounting. The part to be made differently will be definitely the commercial version of an enclosure 400 seen in FIG. 9 and FIGS. 11-12 that encloses inside most of the mechanism and blends the embodiment into the surrounding environment. The extra cost in acquiring a second shape form of enclosure 400, for the sake of better aesthetics for every embodiment, can be justified easily with modern fabrication techniques of plastic vacuum forming or injection molding.

To cope with the variety of optimum lengths of the sheathed cable 64, a maximum length can be chosen at production time. Given the choice of very slippery materials in the sheathed cable 64, the excess in the maximum length of this cable in some of the cases can be made into a single loop, that may be hidden easily from view successfully.

FIG. 9 shows a user depressing pedal 30 that is covered at its reachable end with a silicone tubing 31. The reader may notice the comfortable position of the user's foot with its heel solidly planted on the floor, due to the ergonomic design of the location of pedal 30 and the relatively low setting of supporting feet 1 and 2 for the standardized low range, 14" to 15", of height of toilet bowl rim.

Special-need people who cannot bend down easily usually desire that the actuation of different operations on a toilet system, such as raising or lowering the toilet seat and flushing the toilet, could be done effortlessly with a foot or a cane. For these special people, their desires can be fulfilled with some specially-conceived accessories.

For example, FIG. 12 proposes comforting enlarged areas for actuating pedal 30 or secondary pedal 140. Pedal 30 is seen as fitted with an inclined rectangular plastic foot plate 33 covered with a non-skid material and rotating around a hex bolt 35 that is engaged in a set of co-fasteners (not shown) on pedal 30. To aid foot plate 33 in depressing pedal 30 efficiently, a set of plastic rollers 37 can be affixed to the underside of the free end of foot plate 33 to roll on the floor when the angle of inclination of foot plate 33 varies with the amount of depression on foot plate 33. The reader can notice that with the inclined foot plate 33, the heel of a user's foot can rest on the floor comfortably in spite of the systematic elevating of foot pedal 30 to accommodate the top standardized range of toilet bowl rim height of 16" to 17" as suggested in FIGS. 11-12. Secondary pedal 140 is seen equipped with a rectangular plastic secondary foot plate 142 that can be covered with a non-skid material and secured rigidly onto secondary pedal 140 with a hex bolt 144 along with appropriate co-fasteners located on secondary pedal 140 (not shown). Accessories such as foot plate 33 and 142 may be provided for all ranges of height of toilet bowl rim for special people. Foot plate 142 being usable with all ranges of height is obvious in FIG. 12. The angle of inclination of foot plate 33 shown in FIG. 12 will be automatically reduced for a lower toilet bowl, and even a foot in tremors can aim and be positioned on it with the heel on solid ground easily, similarly to the foot position in FIG. 9.

In another example, an embodiment (not shown) can provide a predetermined contoured structure such as a cup, large enough on a pedal's surface to accept with precision more readily the pushing tip of a cane every time a special-need person venture around using a toilet.

In all the examples of embodiment, many a screw such as 511, 512, 676 and 4 may be predetermined efficaciously to be pop rivets instead of 10-32 stainless screws and co-fasteners. Also, cylindrical eccentric 41 may be replaced by a widely-available simple cylindrical nylon stand-off, predetermined easily along with its co-fasteners' size and location.

Finally, to make it most attractive to buyers, all gaps in enclosure 400 may be equipped with appropriate sliding or self-parting thin plastic-sheet plates to minimize water or dust entering the inside of the enclosure, as well as to enhance the embodiment's appearance.

Advantages

From the description above, the advantages of my hands-free toilet attachment become evident:

[a] My attachment uses no electricity. Results: no electrical shock hazard, no motor or gears that can malfunction due to high humidity in bathrooms.

[b] It is inexpensive, due to the use of simple and thus low-cost reliable binary logic devices.

[c] It works with the greatest majority of unmodified conventional toilet seats and lids which already exist in home and public institutions use.

[d] It provides all the desirable intuitive hands-free operations in raising and lowering the seat and in flushing. It will not startle any user with unusual functions considered as dehumanizing and unnecessary such as spraying water and hot air, on command or worst, automatically, on user's body areas to be usually cleaned efficiently with toilet paper.

[e] At a user's choice, even in the most difficult situation of operating my attachment on a toilet of upper height range (called also comfort height range), the raising of the seat can be done standing balanced on one foot and depressing a pedal with the other foot comfortably with the heel of this last foot on solid ground of the toilet room (see FIG. 9 and FIG. 12). After the seat is raised, the user can stand nonchalantly on both feet to urinate or, especially, to reach out for a piece of toilet paper and to clean with it the inside of the toilet bowl after urinating. This way, the hazard of urinating on the wrong place, or of causing a loud impact noise on the toilet bowl by the release of a pedal as in lesser inventions, due to distraction in foot movements or discomfiture, shall be eradicated. As an apropos, after the seat is raised, a user can have an extra personal choice of sitting down on the bare rim of the toilet bowl for defecation without the toilet seat imposingly leaning unsanitary on the user's back.

[f] After using the toilet with the seat raised as in [e], at a user's choice, even in the most difficult situation of operating my attachment on a toilet of upper height range, the lowering of the seat can be done standing balanced on one foot and depressing a pedal with the other foot comfortably with the heel of this last foot on solid ground of the toilet room (see FIG. 9 and FIG. 12).

[g] At a user's choice, the advantages enumerated in [e] and [f] can be extended to the comfortable and efficient use—only pushing on a pedal and no other unnatural actions—of a walking cane or a portable cane that can be stored on a wheel chair, when not used for other purposes such as self defense.

[h] With my attachment, even in a low-light situation, there is no need to remember which pedal to actuate, and which action to take except depressing on a single and well positioned pedal.

[i] My attachment delivers the definitive solution to the problem of loud noise and high impact in raising and lowering a toilet seat, especially the noise and impact against the water tank which has been hitherto quietly ignored as beyond the teaching of any patent in prior art. My attachment's solution includes happily the low cost and short time-to-market of the correct elements needed in the critical-damping adjustment of a mechanical system in motion (toilet seat in raising or lowering here) for it to reach the final settling position in the shortest time and least amount of oscillations possible. The easily-adjustable gentle pace of seat lowering will offer complete peace of mind to parents of toddlers who are in the period of potty training about the safety of their body parts, especially the genitals of boys.

[j] In a more advanced version, my attachment will add the bonus of the concurrent toilet flushing automatically at seat lowering time, as efficaciously as in the conventional manner of doing it manually.

[k] In yet a more advanced version, my attachment will help any member of users in flushing the toilet with a foot conveniently after using it with the seat in the down position already (think of female or male users after defecation including special-need people).

[l] My attachment will honor always, with no apparent resistance, all the conventional manual actions on a toilet system such as raising or lowering the seat or flushing. This will help in not surprising and embarrassing a user who is not aware of the presence of my attachment. It will also accommodate obligingly the wish of any user to flush several times during a session of use of the toilet.

[m] Honoring always, with no apparent resistance, all the conventional manual actions as in [l], my attachment will put a smile of satisfaction instead of a cursing word on the lips of a user who is aware of the presence of my attachment but not familiar about how it works, and just goes ahead to take conventional manual actions, hoping expectingly that the attachment was well conceived enough to preserve all the usual manual actions; or just goes ahead to take conventional manual actions in a forceful manner and expects that if the attachment is damaged in the process, that will be a lesson to the designer.

[n] In any conceivably rare intricate situations that could arrive during the lifetime of my attachment, it will extricate itself harmlessly from damages that would be inflicted upon lesser devices. Two of these intricate situations have been imposed as tests: One, foot-actuated raising of a toilet seat with my attachment followed by a supposedly inadvertent lowering of same seat by hand. Two, supposedly raising inadvertently a toilet seat by hand then catching up with foot-raising of same seat with my attachment. In both separate intricate situations, my attachment would come out unscathed and would not upset any subsequent hands-free actuation on the toilet on which it was attached.

[o] My attachment can be set up during initial installation, or subsequently, to raise or lower successfully both a toilet seat and its lid without any apparent extra effort on the part of a user or any permanent shape changing of any part of the attachment.

[p] My attachment can even raise or lower successfully with regular ease some toilet seats which are fitted unusually with cushioning bumps underneath the seat on the area that the attachment would employ to maintain intimate contact with the seat. This would be done easily by bending harmlessly some readily pliable elements of the attachment after a few initial trial runs.

[q] The same operating elements inside and only two versions of outside assembly of my attachment will accommodate all manners of installation, on the right or on the left sides, on all the heights of toilet bowl rim covering the standardized range from 14" to 15" and range from 16" to 17", plus every height in between. No modifications are required on the toilet or the surrounding structure; especially, no required bolting of the attachment on the floor. Installation is expected to be possible under five minutes, using no special tools.

[r] As per design, my attachment shall have permanent lubrication and component strength to last more than ten years of twenty cycles of operations a day.

[s] My attachment shall have a pleasant and friendly appearance, resistance to stains, water splashing and cleaning chemicals around bathrooms and shall preserve the easy cleaning of surrounding space.

Conclusion, Ramifications, and Scope

Accordingly, the reader will see that the embodiments of this invention can be used to provide many people with a truly comprehensive hands-free attachment for operating different toilet systems already in use or to be designed and manufactured in the future. These effective embodiments can have ramifications into other possible variations that would provide most if not all the benefits of the first embodiment of this application.

One example is an embodiment (not shown) that will make a propitious use of the consistently precise position of one of the nuts and bolts that attached the toilet bowl onto a hidden ring around the drain hole of the toilet, or onto a hidden fixture inside of the toilet bowl, which was already solidly bolted onto the floor. Such consistently precise position can be enjoyed by a model or a series of models of toilet bowl to be produced massively for a special or general market. The propitious use of the consistently precise position of one of these nuts and bolts is to secure a means (not shown) of immobilizing the embodiment as achieved by lower bracket 14 of the first embodiment, yet to hide this means from view of any one looking at the toilet system, and thus to enhance the aesthetics of the embodiment. This means (not shown) may be, for example, a precisely bent one-piece bracket of predetermined metal or acetal, having a first circular aperture, which can be considered as an aggregated number of points, that is tailored to sleeve snuggly and to stay by hard friction, on a commercially available plastic cap that mates intimately and stay by hard friction on a chosen nut of the aforementioned nuts and bolts. This bracket has further a circular second aperture for affixing it onto a predetermined point on the hidden back side of base plate 20 with a bolt and a washer as in the first embodiment.

Yet another example is an embodiment (not shown) that will make use of the position of one of the nuts and bolts that conventionally attached many a toilet bowl onto a hidden ring around the drain hole of the toilet, which was already solidly bolted onto the floor. A survey has shown that the usable position of one of these nuts and bolts on a side of a toilet bolt can vary from a vertical plan through the centers of the two standardized apertures for toilet seat fixture (located on the toilet rim) through a range of about 2". To accommodate this range of variation and also the range of rim height from 14" to 17" that an embodiment would cover, a variable lower bracket can be tailored in a multi-piece configuration, adjustable in at least three directions (not shown). The first circular aperture of this bracket, which can be considered as an aggregated number of points, is also specifically tailored to sleeve snuggly and to stay by hard friction, on a commercially available plastic cap that mates intimately and stay by hard friction on a chosen nut of the aforementioned nuts and bolts.

In these last two proposed lower brackets, the unconventional use of the first circular aperture of these brackets avoids an arduously difficult—and potentially harmful to the integrity of the wax sealing ring on the drain hole—task of completely or partially removing a nut on a side of the toilet bowl to affix a lower bracket required by lesser designs.

The built-in supporting feet, in predetermined number from one to several, of the embodiment will take care of the positioning of the base plate on the bathroom floor according to different rim heights. They will cooperate with any upper and lower brackets to immobilize successfully any embodiment of this invention for day-to-day operations.

Although the description above contains many specificities, these should not be construed as limiting the scope of the invention but as merely providing illustrations of some of the presently preferred embodiments of this invention.

Thus the scope of the invention should be determined by the appended claims and their equivalents, rather than by the examples given.

What I claim is:

1. A hands-free toilet attachment on a toilet system that has as existing equipment the following:

(a) a toilet bowl, with a rim on top, and with rim height standardized in definite ranges;

(b) a seat, attached conventionally to swivel up vertically and down horizontally, on top of said toilet bowl through standardized apertures on said toilet bowl with predetermined nuts and bolts;

(c) a water tank, having a tank container with a tank top; a tank cover; a flushing mechanism actuated with a flushing rod inside said tank container; and a flushing lever outside of said tank container; for the conventional flushing of said toilet bowl;

(d) a lid, attached conventionally to swivel up vertically to rest against said water tank and down horizontally to rest on top of said seat, along said seat or independently of said seat when possible; and (e) a wall behind said toilet bowl;

said hands-free toilet attachment on a toilet system comprising, in combination:

(a) a base plate, serving as a planar supporting member having paralleled, opposed major faces;

(b) a foot pedal, pivoting on a plan parallel to the opposed major faces of said base plate, around a first axis at one of its ends;

(c) a first lever, pivoting on a plan parallel to the opposed major faces of said base plate, around a second axis at one of its ends;

(d) a second lever, pivoting on a plan parallel to the opposed major faces of said base plate, around a third axis at one of its ends;

(e) a third lever, pivoting on a plan parallel to the opposed major faces of said base plate, around said same third axis at one of its ends;

(f) a mechanical toggle, serving as a memory of the transient period when said seat is urged to be falling down;

(g) a first arm of said mechanical toggle, pivoting on a plan parallel to the opposed major faces of said base plate, around a fourth axis at one of its ends;

(h) a first U-shaped metal rod, transmitting said foot pedal movements onto said first lever on the swinging down movement only, while detaching said foot pedal from said first lever during the time said foot pedal swings up;

(i) a second U-shaped metal rod, transmitting said foot pedal movements onto said first arm of said mechanical toggle;

(j) a third U-shaped metal rod, serving as a second arm of said mechanical toggle, and transmitting the movements of said first arm of said mechanical toggle onto a fulcrum on said third lever;

(k) a fourth and fifth U-shaped metal rods, transmitting the movements of said first lever onto a predetermined aperture and a predetermined cut out area of said second lever, respectively, so as to be able to raise said seat when it has been in the lowered position by depressing said foot pedal to its lowest position and then releasing it; and to free said seat in the initial lowering of said seat by depressing said foot pedal to its lowest position and then releasing it, when said seat has been in the raised position; and to transmit the movement of said second lever onto said first lever in the remaining course of said seat lowering under the continuous effect of gravity on said seat;

(l) a mechanical flip-flop, serving as a memory of the up or down state of said toilet seat, pivoting on a plan parallel to the opposed major faces of said base plate, around a fifth axis on a predetermined point of a support plate of said mechanical flip-flop; said mechanical flip-flop having pushing means to push the tip of said fifth lever to one or the other of two limiting positions according to the past memory state stored in said mechanical flip-flop with each depression on said foot pedal, and then storing the new memory state with the help of a built-in snapping means;

(m) a sixth U-shaped metal rod, transmitting said foot pedal movements onto said mechanical flip-flop;

(n) a first torsional spring, wrapping around said second axis, urging said first lever, when free, to swing upward after said first lever is pulled downward by said foot pedal, for the purpose of latching said seat into a stable position leaning against said lid in front of said water tank in predetermined cooperation with the upper end of said fifth U-shaped metal rod; said first torsional spring being there also for the purpose of moving the upper end of said fifth U-shaped metal rod, at the right time, into freeing said second lever for it to rotate away from the underside of said seat;

(o) a second torsional spring on said first lever that bears against the lower end of said fifth U-shaped metal rod to cooperate in a predetermined manner with said second lever to accommodate harmlessly an inadvertent manual lowering of said seat when it has been latched into the raised position;

(p) a metal Z-shaped wire form anchored on a predetermined point of said mechanical flip-flop, serving, when said seat is being lowered, to reset said mechanical flip-flop correctly for raising said seat the next time when said foot pedal is depressed, if said seat lowering operation caused any disturbance in said mechanical flip-flop memory;

(q) a first rolling pin, preferably made pliable, rolling freely but snuggly inside an aperture on said second lever, and covered all around its part outside of said aperture on said second lever with a tubing, preferably of semi-rigid plastic, serving as means to raise said seat alone or said seat and lid together;

(r) a second rolling pin, preferably made pliable, rolling freely but snuggly inside an aperture on said third lever, and covered all around its part outside of said aperture on said third lever with a tubing, preferably of semi-rigid plastic, serving, along with said first rolling pin, as means to lower seat alone or said seat and lid together;

(s) an extension spring, attached to the upper end of said sixth rod and to the lower end of a J-shaped wire form; the upper end of said J-shaped wire form being attached to said third axis common to said second and said third levers; said extension spring being biased to pull the upper end of said sixth U-shaped metal rod toward said third axis to rest at an apex of said support plate of said mechanical flip-flop;

(t) a first link strip, attached at its two ends with nylon tying straps of predetermined strength to the upper end of said sixth U-shaped metal rod and a predetermined point of said second U-shaped metal rod; said first link strip serving as a mechanical linkage that maintains said sixth U-shaped metal rod and said second U-shaped metal rod in a predetermined angular position with respect to each other in all movements of said sixth and second U-shaped metal rods;

(u) an upper bracket, serving to affix a first predetermined point of said base plate onto a predetermined location on said toilet bowl selected from the group consisting of the surface areas on the rim of said toilet bowl at the vicinity of the standardized apertures of said toilet bowl provided for the fixture of said seat for conventional use with said toilet bowl; said upper bracket positioning in a predetermined manner said first and second rolling pins for the raising and lowering of said seat alone or said seat and lid together;

(v) a predetermined plurality of supporting feet, joined to said base plate at spaced locations to bear onto the surface that supports said toilet bowl, and adjustable so as to enable said hands-free attachment on a toilet system to work with different sizes of said rim height; and (w) a lower bracket, serving to affix a second predetermined point of said base plate to bear onto a predetermined point selected from the group consisting of a predetermined point on said wall behind said toilet bowl and a predetermined aggregated number of points on said toilet bowl; said lower bracket serving cooperatively with said plurality of supporting feet and said upper bracket as means to counter a force on said base plate every time said foot pedal is depressed;

whereby, when said seat has been in the lowered position, operating twice the sequence of depressing said foot pedal by any means to its lowest position then releasing for it to rise to its highest position, said hands-free attachment on a toilet system provides a dual operation selected from the group consisting of:

(1) raising said seat alone, then lowering said seat alone;

(2) raising said seat and lid together, then lowering said seat alone; and (3) raising said seat and lid together, then lowering said seat and lid together;

each time of operating the sequence being separated from the next with a chosen time interval.

2. A hands-free attachment on a toilet system as in claimed 1 that includes a conventionally-designed dashpot to be attached on said first lever and said base plate so as to be able to regulate the speed of the lowering of said seat alone or said seat and lid together.

3. A hands-free attachment on a toilet system as in claimed 2 that includes means to flush said toilet system, with the same result as the conventional manual flushing, during the lowering of said seat alone or said seat and lid together.

4. A hands-free attachment on a toilet system as in claimed 3 wherein said means to flush said toilet system includes cable means to link the movement of said first arm of said mechanical toggle to a linkage rod means attached on the tank top of said tank container so as to be able to ultimately latch into opening a predetermined aperture of said water tank to discharge quickly the water in said water tank for flushing in a predetermined flushing apparatus of said toilet system.

5. A hands-free attachment on a toilet system as in claimed 4 that includes a secondary pedal distinctly made smaller than, and positioned away from, said foot pedal for strictly actuating only said first arm of said mechanical toggle, via a seventh U-shaped rod, to flush said toilet system any time without moving said toilet seat when said toilet seat is already in the lowered position.

* * * * *